US006848434B2

(12) United States Patent
Li et al.

(10) Patent No.: US 6,848,434 B2
(45) Date of Patent: Feb. 1, 2005

(54) SYSTEM FOR DIAGNOSING OPERATION OF AN EGR COOLER

(75) Inventors: Xiaoqiu Li, Columbus, IN (US); Yue Yun Wang, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 44 days.

(21) Appl. No.: 10/390,417

(22) Filed: Mar. 17, 2003

(65) Prior Publication Data

US 2004/0182373 A1 Sep. 23, 2004

(51) Int. Cl.[7] ..... F02M 25/07

(52) U.S. Cl. ..... 123/568.12; 123/568.16; 60/605.2

(56) References Cited

U.S. PATENT DOCUMENTS

| | | | | |
|---|---|---|---|---|
| 4,164,206 | A | 8/1979 | Toelle | 123/568.27 |
| 4,793,318 | A | 12/1988 | Tsurusaki | 123/676 |
| 4,870,941 | A | 10/1989 | Hisatomi | 123/676 |
| 4,967,717 | A | 11/1990 | Miyazaki et al. | 73/116 |
| 4,974,572 | A | 12/1990 | Aramaki | 73/116 |
| 5,014,203 | A | 5/1991 | Miyazaki et al. | 701/108 |
| 5,190,017 | A | 3/1993 | Cullen et al. | 123/676 |
| 5,209,212 | A | 5/1993 | Vess et al. | 123/568.16 |
| 5,239,971 | A | 8/1993 | Uchinami | 123/698 |
| 5,257,610 | A | 11/1993 | Ohuchi | 123/568.16 |
| 5,309,887 | A | 5/1994 | Kondo et al. | 123/568.16 |
| 5,474,051 | A | 12/1995 | Matsumoto et al. | 123/568.16 |
| 5,508,926 | A | 4/1996 | Wade | 701/29 |
| 5,540,091 | A | 7/1996 | Nakagawa | 73/117.3 |
| 5,617,726 | A | 4/1997 | Sheridan et al. | 60/605.2 |
| 5,632,257 | A | 5/1997 | Machida et al. | 123/435 |
| 5,675,080 | A | 10/1997 | Wada | 73/118.1 |
| 5,703,825 | A | 12/1997 | Akiba et al. | 365/229 |
| 5,727,533 | A * | 3/1998 | Bidner et al. | 123/568.16 |
| 5,732,688 | A | 3/1998 | Charlton et al. | 123/568.12 |
| 5,916,130 | A | 6/1999 | Nakae et al. | 60/276 |
| 6,009,709 | A | 1/2000 | Bailey | 60/605.2 |
| 6,085,732 | A | 7/2000 | Wang et al. | 123/568.12 |
| 6,098,602 | A | 8/2000 | Martin et al. | 123/568.23 |
| 6,102,015 | A | 8/2000 | Tsuyuki et al. | 123/568.16 |
| 6,116,083 | A | 9/2000 | Cullen et al. | 73/118.1 |
| 6,164,270 | A | 12/2000 | Bidner et al. | 123/568.16 |
| 6,216,460 | B1 | 4/2001 | Shao et al. | 60/605.2 |
| 6,216,461 | B1 | 4/2001 | Shao et al. | 60/605.2 |
| 6,257,214 | B1 | 7/2001 | Bidner et al. | 123/568.16 |
| 6,347,519 | B1 | 2/2002 | Kresco | 60/602 |
| 6,367,256 | B1 | 4/2002 | McKee | 60/605.2 |
| 6,378,515 | B1 | 4/2002 | Geyer | 123/683 |
| 6,401,457 | B1 | 6/2002 | Wang et al. | 60/599 |
| 6,401,700 | B2 * | 6/2002 | Balekai et al. | 123/568.12 |
| 2001/0045209 | A1 | 11/2001 | Balekai et al. | 123/568.12 |
| 2002/0144674 | A1 * | 10/2002 | Wang et al. | 123/568.12 |
| 2003/0234009 | A1 * | 12/2003 | Kennedy et al. | 123/568.12 |
| 2004/0084030 | A1 * | 5/2004 | Matsunaga et al. | 123/568.12 |

* cited by examiner

*Primary Examiner*—Willis R. Wolfe, Jr.
(74) *Attorney, Agent, or Firm*—Barnes & Thornburg

(57) ABSTRACT

A system is disclosed for diagnosing operation of an EGR cooler disposed in-line with an EGR conduit fluidly coupled between an intake manifold and an exhaust manifold of the engine such that exhaust gas flowing through the EGR conduit also flows through the EGR cooler. The EGR cooler is coupled to an engine cooling system such that coolant fluid circulating through the engine also circulates through the EGR cooler. Means are provided for determining a temperature of exhaust gas produced by the engine, a temperature of exhaust gas exiting the EGR cooler, a temperature of the coolant fluid and a flow rate of exhaust gas through the EGR conduit. A control computer is configured to diagnose operation the EGR cooler as a function of the temperature of exhaust gas produced by the engine, the EGR cooler outlet temperature, the engine coolant temperature and the EGR flow rate.

48 Claims, 8 Drawing Sheets

SYSTEM FOR DIAGNOSING OPERATION OF AN EGR COOLER

FIELD OF THE INVENTION

The present invention relates generally to systems for monitoring the operation of an exhaust gas cooler in an exhaust gas recirculation (EGR) system, and more specifically to systems for diagnosing EGR cooler fouling conditions.

BACKGROUND OF THE INVENTION

When combustion occurs in an environment with excess oxygen, peak combustion temperatures increase which leads to the formation of unwanted emissions, such as oxides of nitrogen ($NO_x$). This problem is aggravated through the use of turbocharger machinery operable to increase the mass of fresh air flow, and hence increase the concentrations of oxygen and nitrogen present in the combustion chamber when temperatures are high during or after the combustion event.

One known technique for reducing unwanted emissions such as $NO_x$ involves introducing chemically inert gases into the fresh air flow stream for subsequent combustion. By thusly reducing the oxygen concentration of the resulting charge to be combusted, the fuel burns slower and peak combustion temperatures are accordingly reduced, thereby lowering the production of $NO_x$. In an internal combustion engine environment, such chemically inert gases are readily abundant in the form of exhaust gases, and one known method for achieving the foregoing result is through the use of a so-called Exhaust Gas Recirculation (EGR) system operable to selectively introduce (i.e., recirculate) exhaust gas from the exhaust manifold into the fresh air stream flowing to the intake manifold via a controllable EGR valve. Through the use of an on-board microprocessor, control of the EGR valve is typically accomplished as a function of information supplied by a number of engine operational sensors.

It is known that recirculation of exhaust gas into the fresh air stream generally increases the temperature of air charge entering the intake manifold, which under some engine operating conditions can frustrate the goals of an EGR system. Accordingly, some known EGR systems employ a conventional EGR cooler that is typically positioned in-line with the EGR conduit fluidly coupling the exhaust manifold to the intake manifold. Such EGR coolers effectively control the temperature of exhaust gas being introduced into the intake manifold.

It is desirable to monitor the operation of such EGR coolers to ensure proper operation and effectiveness of such EGR coolers. What is therefore needed is a system for monitoring the operation of an EGR cooler and diagnosing EGR cooler fouling conditions as they may occur.

SUMMARY OF THE INVENTION

The present invention may comprise one or more of the following features and combinations thereof. A system for diagnosing operation of an exhaust gas recirculation (EGR) cooler may comprise an engine having an intake manifold, an exhaust manifold and an EGR conduit fluidly coupled between the intake and exhaust manifolds, wherein the engine further includes a cooling system having a coolant fluid circulating therethrough to cool the engine. An EGR cooler is disposed in-line with the EGR conduit such that exhaust gas flowing through the EGR conduit also flows through the EGR cooler, and the EGR cooler is operatively coupled to the cooling system such that the coolant fluid circulates through the EGR cooler to cool exhaust gas flowing therethrough. Means are provided for determining a temperature of exhaust gas produced by the engine, a temperature of exhaust gas exiting an exhaust gas outlet of the EGR cooler, a temperature of the coolant fluid and a flow rate of exhaust gas through the EGR conduit. A control computer is configured to diagnose operation the EGR cooler as a function of the temperature of exhaust gas produced by the engine, the EGR cooler outlet temperature, the engine coolant temperature and the flow rate of exhaust gas through the EGR conduit.

The control computer may be configured to compute an EGR cooler effectiveness ratio as a function of the temperature of exhaust gas produced by the engine, the EGR cooler outlet temperature and the engine coolant temperature. In one embodiment, for example, the control computer may be configured to compute a first temperature difference between the temperature of exhaust gas produced by the engine and the EGR cooler outlet temperature, to compute a second temperature difference between the temperature of exhaust gas produced by the engine and the engine coolant temperature, and to compute the EGR cooler effectiveness ratio as a ratio of the first and second temperature differences.

The control computer may further be configured to compute a first EGR cooler effectiveness ratio threshold as a function of the flow rate of exhaust gas through the EGR conduit.

The control computer may be configured to compare the EGR cooler effectiveness ratio with the first EGR cooler effectiveness ratio threshold and diagnose the EGR cooler as a fouled EGR cooler if the EGR cooler effectiveness ratio is less than the first EGR cooler effectiveness ratio threshold.

The control computer may further include a fail counter having a count value, and the control computer may be configured to diagnose the EGR cooler as a fouled EGR cooler if the EGR cooler effectiveness ratio is less than the first EGR cooler effectiveness ratio threshold and if the count value of the fail counter has reached a fail count. The control computer may be configured to repeatedly compute and compare the EGR cooler effectiveness ratio and the first EGR cooler effectiveness ratio threshold, and to change the count value of the fail counter for each comparison that the EGR cooler effectiveness ratio is less than the first EGR cooler effectiveness ratio threshold.

The control computer may be configured to compute a second EGR cooler effectiveness ratio threshold as a function of the flow rate of exhaust gas through the EGR conduit, wherein the second EGR cooler effectiveness ratio greater than the first EGR cooler effectiveness ratio.

The control computer may be configured to compare the EGR cooler effectiveness ratio with the second EGR cooler effectiveness ratio threshold and diagnose the EGR cooler as operating normally if the EGR cooler effectiveness ratio is greater than the second EGR cooler effectiveness ratio threshold.

The control computer may further include a pass counter having a count value, and the control computer may be configured to diagnose the EGR cooler as operating normally if the EGR cooler effectiveness ratio is greater than the second EGR cooler effectiveness ratio threshold and if the count value of the pass counter has reached a pass count. The control computer may be configured to repeatedly compute and compare the EGR cooler effectiveness ratio and the second EGR cooler effectiveness ratio threshold, and to change the count value of the pass counter for each comparison that the EGR cooler effectiveness ratio is greater than the first EGR cooler effectiveness ratio threshold.

The control computer may be configured to abort diagnostic operation of the IS EGR cooler if the EGR cooler effectiveness ratio is greater than or equal to the first EGR cooler effectiveness ratio threshold and less than or equal to the second EGR cooler effectiveness ratio threshold.

The system may further include means for determining an operating cycle of the engine and a malfunction indicator lamp. The control computer may be configured to activate the malfunction indicator lamp if the EGR cooler is diagnosed as a fouled EGR cooler for at least a first number of consecutive engine operating cycles, and to deactivate the malfunction indicator lamp if the EGR cooler is otherwise diagnosed for at least a second number of consecutive engine operating cycles.

The control computer may alternatively be configured to compute an EGR cooler effectiveness ratio as a function of the flow rate of exhaust gas through the EGR conduit. In this embodiment, the control computer may further be configured to compute an expected temperature of exhaust gas exiting the EGR cooler as a function of the EGR cooler effectiveness ratio, the temperature of exhaust gas produced by the engine, and the engine coolant temperature. For example, the control computer may be configured to compute a temperature difference between the temperature of exhaust gas produced by the engine and the engine coolant temperature, to compute a product of the EGR cooler effectiveness ratio and the temperature difference, and to compute the expected temperature of exhaust gas exiting the EGR cooler as a difference between the temperature of exhaust gas produced by the engine and the product of the EGR cooler effectiveness ratio and the temperature difference.

The control computer may further be configured in this embodiment to diagnose the EGR cooler as a fouled EGR cooler if the EGR cooler outlet temperature is greater than a sum of the expected temperature of exhaust gas exiting the EGR cooler and a temperature constant.

The control computer in this embodiment may further include a fail counter having a count value and the control computer may be configured to diagnose the EGR cooler as a fouled EGR cooler if the EGR cooler outlet temperature is greater than the sum of the expected temperature of exhaust gas exiting the EGR cooler and the temperature constant and if the count value of the fail counter has reached a fail count. The control computer may further be configured to repeatedly compute the EGR cooler effectiveness ratio and the expected temperature of exhaust gas exiting the EGR cooler, and to compare current values of the EGR cooler outlet temperature with the expected temperature of exhaust gas exiting the EGR cooler, and further to change the count value of the fail counter for each comparison that the EGR cooler outlet temperature is greater than the sum of the expected temperature of exhaust gas exiting the EGR cooler and the temperature constant.

The control computer may further be configured in this embodiment to diagnose the EGR cooler as operating normally if the EGR cooler outlet temperature is less than the expected temperature of exhaust gas exiting the EGR cooler. In this embodiment, the control computer may include a pass counter having a count value, and the control computer may be configured to diagnose the EGR cooler as operating normally if the EGR cooler outlet temperature is less than the expected temperature of exhaust gas exiting the EGR cooler and if the count value of the pass counter has reached a pass count. The control computer may further be configured in this embodiment to repeatedly compute the EGR cooler effectiveness ratio and the expected temperature of exhaust gas exiting the EGR cooler, and to compare current values of the EGR cooler outlet temperature with the expected temperature of exhaust gas exiting the EGR cooler, and further to change the count value of the pass counter for each comparison that the EGR cooler outlet temperature is less than the expected temperature of exhaust gas exiting the EGR cooler.

The control computer may further be configured in this embodiment to abort diagnostic operation of the EGR cooler if the EGR cooler outlet temperature is greater than or equal to the expected temperature of exhaust gas exiting the EGR cooler and is less than or equal to the sum of the expected temperature of exhaust gas exiting the EGR cooler and a temperature constant.

The system in this embodiment may further include means for determining an operating cycle of the engine and a malfunction indicator lamp, wherein the control computer may be configured in this embodiment to activate the malfunction indicator lamp if the EGR cooler is diagnosed as a fouled EGR cooler for at least a first number of consecutive engine operating cycles, and to deactivate the malfunction indicator lamp if the EGR cooler is not diagnosed as a fouled EGR cooler for at least a second number of consecutive engine operating cycles.

These and other objects of the present invention will become more apparent from the following description of the illustrative embodiments.

DESCRIPTION OF THE ILLUSTRATIVE EMBODIMENTS

Figure 1:
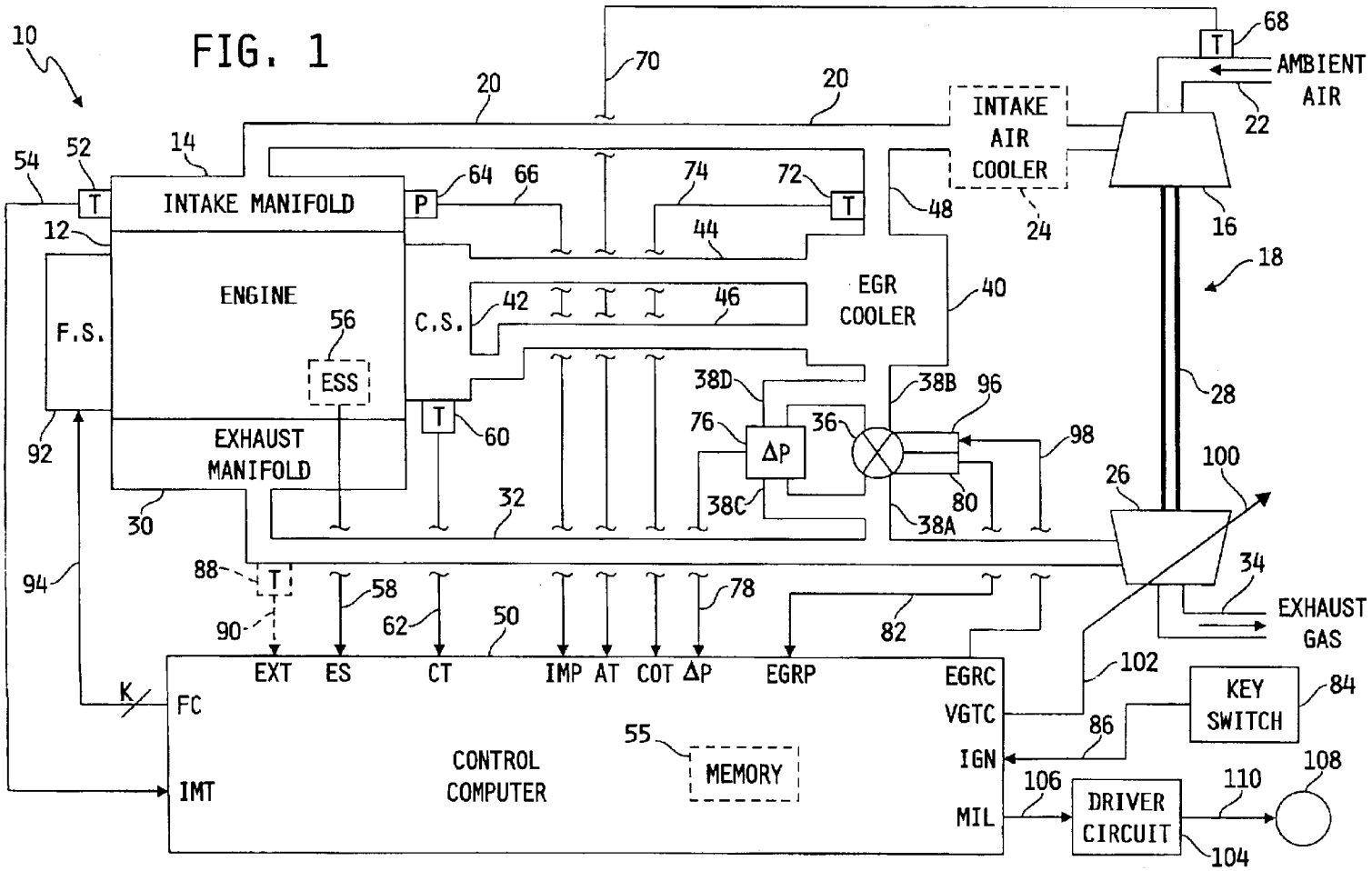
FIG. 1 is a diagram of one illustrative embodiment of a system for diagnosing operation of an EGR cooler.

For the purposes of promoting an understanding of the principles of the invention, reference will now be made to a number of preferred embodiments illustrated in the drawings and specific language will be used to describe the same. It will nevertheless be understood that no limitation of the scope of the invention is thereby intended.

Referring now to FIG. 1, a diagram of one illustrative embodiment of a system 10 for diagnosing operation of an EGR cooler in an internal combustion engine is shown. System 10 includes an internal combustion engine 12 having an intake manifold 14 fluidly coupled to an outlet of a compressor 16 of a turbocharger 18 via an intake conduit 20, wherein the compressor 16 includes a compressor inlet coupled to an intake conduit 22 for receiving fresh ambient air therefrom. Optionally, as shown in phantom in FIG. 1, system 10 may include an intake air cooler 24 of known construction disposed in-line with intake conduit 20 between the turbocharger compressor 16 and the intake manifold 14. The turbocharger compressor 16 is mechanically coupled to a turbocharger turbine 26 via a drive shaft 28, wherein turbine 26 includes a turbine inlet fluidly coupled to an exhaust manifold 30 of engine 12 via an exhaust conduit 32, and further includes a turbine outlet fluidly coupled to ambient via an exhaust conduit 34. An EGR valve 36 includes an EGR inlet fluidly coupled to one end of an EGR conduit 38A, wherein conduit 38A has an opposite end fluidly coupled to the exhaust conduit 32. An EGR outlet of the EGR valve 36 is fluidly coupled to one end of another EGR conduit 38B, wherein conduit 38B has an opposite end fluidly coupled to an EGR inlet orifice of an EGR cooler 40. The EGR cooler is fluidly coupled to the engine cooling system 42 via fluid-carrying conduits 44 and 46. As is known in the art, coolant fluid circulating through the engine coolant system thus circulates through the EGR cooler 40, via conduits 44 and 46, to cool exhaust gas flowing therethrough. An exhaust gas outlet orifice of the EGR cooler 40 is fluidly coupled to one end of yet another EGR conduit 48, wherein an opposite end of conduit 48 is fluidly coupled to the intake conduit 20.

System 10 includes a control computer 50 that is generally operable to control and manage the overall operation of engine 12. Control computer 50 includes a memory unit 55 as well as a number of inputs and outputs for interfacing with various sensors and systems coupled to engine 12. Control computer 50 is, in one embodiment, microprocessor-based and may be a known control unit sometimes referred to as an electronic or engine control module (ECM), electronic or engine control unit (ECU) or the like, or may alternatively be a general purpose control circuit capable of operation as will be described hereinafter. In any case, control computer 50 includes one or more control algorithms, as will be described in greater detail hereinafter, for diagnosing fouling conditions associated with the EGR cooler 40.

Control computer 50 includes a number of inputs for receiving signals from various sensors or sensing systems associated with system 10. For example, system 10 includes an intake manifold temperature sensor 52 disposed in fluid communication with the intake manifold 14 of engine 12, and electrically connected to an intake manifold temperature input, IMT, of control computer 50 via signal path 54. Intake manifold temperature sensor 52 may be of known construction, and is operable to produce a temperature signal on signal path 54 indicative of the temperature of air charge flowing into the intake manifold 14, wherein the air charge flowing into the intake manifold 14 is generally made up of fresh air supplied by the turbocharger compressor 16 combined with recirculated exhaust gas that is controllably routed through EGR valve 36.

System 10 further includes an engine speed sensor 56 electrically connected to an engine speed input, ES, of control computer 50 via signal path 58. Engine speed sensor 56 is operable to sense rotational speed of the engine 12 and produce an engine speed signal on signal path 58 indicative of engine rotational speed. In one embodiment, sensor 56 is a Hall effect sensor operable to determine engine speed by sensing passage thereby of a number of equi-angularly spaced teeth formed on a gear or tone wheel. Alternatively, engine speed sensor 56 may be any other known sensor operable as just described including, but not limited to, a variable reluctance sensor or the like.

System 10 further includes a coolant temperature sensor 60 disposed in fluid communication with the engine cooling system 42 and electrically connected to a coolant temperature input, CT, of control computer 50 via signal path 62. Coolant temperature sensor 60 may be of known construction, and is operable to produce a temperature signal on signal path 62 indicative of the temperature of the coolant fluid circulating through the engine cooling system 42, and therefore also generally indicative of engine operating temperature.

System 10 further includes an intake manifold pressure sensor 64 disposed in fluid communication with intake manifold 14 and electrically connected to an intake manifold pressure input, IMP, of control computer 50 via signal path 66. Alternatively, pressure sensor 64 may be disposed in fluid communication with intake conduit 20. In any case, pressure sensor 64 may be of known construction, and is operable to produce a pressure signal on signal path 66 indicative of the pressure within intake conduit 20 and intake manifold 14.

System 10 further includes an ambient air temperature sensor 68 disposed in fluid communication with ambient air intake conduit 22 and electrically connected to an ambient temperature input, AT, of control computer 50 via signal path 70. Ambient temperature sensor 68 may be of known construction, and is operable to produce a temperature signal on signal path 70 indicative of the temperature of ambient air entering intake conduit 22. Alternatively, the ambient air temperature sensor 68 may be located elsewhere relative to system 10 in a location suitable for detecting ambient air temperature.

System 10 further includes an EGR cooler orifice temperature sensor 72 disposed in fluid communication with EGR conduit 48 adjacent to the EGR cooler outlet orifice and electrically connected to an EGR cooler orifice temperature input, COT, of control computer 50 via signal path 74. EGR cooler orifice temperature sensor 72 may be of known construction, and is operable to produce a temperature signal on signal path 74 indicative of the temperature of exhaust gas exiting the exhaust gas outlet of the EGR cooler 40. Alternatively, the temperature sensor 72 may be located elsewhere along EGR conduit 48 in a location suitable for detecting the temperature of exhaust gas exiting the exhaust gas outlet of the EGR cooler 40.

System 10 further includes a differential pressure sensor, or ΔP sensor, 76 having one inlet fluidly coupled to one end of an EGR conduit 38C having an opposite end fluidly connected to EGR conduit 38A adjacent to the exhaust gas inlet of EGR valve 36, and an opposite inlet fluidly coupled to one end of another EGR conduit 38D having an opposite end fluidly coupled to EGR conduit 38B adjacent to the exhaust gas outlet of EGR valve 36. Alternatively, the ΔP sensor 76 may be coupled across another flow restriction mechanism disposed in-line with any of EGR conduits 38A, 38B or 48. Is In any case, the ΔP sensor 76 may be of known construction and is electrically connected to a ΔP input of control computer 50 via signal path 78. The ΔP sensor 76 is operable to provide a differential pressure signal on signal path 78 indicative of the pressure differential across EGR valve 36 or other flow restriction mechanism as just described.

System 10 further includes a key switch 84 electrically connected to an ignition input, IGN, of control computer 50 via signal path 86. Ignition switch 84 may be of known construction and has three switch positions; "off", "on" and "crank." As is known in the art, system power is applied to control computer 50 and other subsystems within system 10 when the ignition switch 84 is switched from the "off" position to the "on" position, and the engine starting system (not shown) is activated when the ignition switch 84 is switched from the "on" to the "crank" position.

System 10 may optionally include an engine exhaust temperature sensor 88 disposed in fluid communication with exhaust conduit 32 and electrically connected to an engine exhaust temperature input, EXT, of control computer 50 via signal path 90, as shown in phantom in FIG. 1. Alternatively, sensor 88 may be disposed in fluid communication with the exhaust manifold 30. In either case, temperature sensor 88 is operable to provide a temperature signal on signal path 90 indicative of the temperature of exhaust gas produced by engine 12.

Control computer 50 also includes a number of outputs for controlling one or more engine functions associated with system 10. For example, EGR valve 36 includes an EGR valve actuator 96 electrically connected to an EGR valve control output, EGRC, of control computer 50 via signal path 98. Control computer 50 is operable to produce an EGR valve control signal on signal path 98, and actuator 96 is responsive to the EGR valve control signal to control the position of EGR valve 36 relative to a reference position in a known manner. Control computer 50 is accordingly operable to control EGR valve 36 in a known manner to selectively provide a flow of recirculated exhaust gas from exhaust manifold 30 to intake manifold 14. EGR valve 36 further includes an EGR position sensor 80 electrically connected to an EGR valve position input, EGRP, of control computer 50 via signal path 82. Sensor 80 may be of known construction and is operable to determine a position of EGR valve 36 by determining a position of EGR valve actuator 96 relative to a reference actuator position, and producing a position signal on signal path 82 indicative of the position of EGR valve 36 relative to a reference position.

System 10 further includes a fuel system 92 electrically connected to a fuel command output, FC, of control computer 50 via a number, K, of signal paths 94 wherein K may be any positive integer. Fuel system 92 is responsive to the fueling commands, FC, produced by control computer 50 to supply fuel to engine 12 in a known manner.

System 10 further includes a variable geometry turbocharger (VGT) mechanism, shown generally as 100, and electrically connected to a VGT control output, VGTC, of control computer 50 via signal path 102. The VGT mechanism may be embodied as any combination of a mechanical or electromechanical mechanism controllable in a known manner modify the effective geometry of the turbocharger turbine 26, a wastegate disposed between conduits 32 and 34 and controllable in a known manner to selectively route exhaust gas around the turbine 26 and an exhaust throttle disposed in-line with either of conduits 32 and 34 and controllable in a known manner to selectively restrict exhaust gas flow through conduits 32 and 34 and turbine 26. Control computer 50 is accordingly operable to control any one or more of these VGT mechanisms in a known manner to selectively control the swallowing capacity and/or efficiency of the turbocharger 18.

System 10 further includes a driver circuit 104 of known construction and having an input electrically connected to a malfunction indicator lamp (MIL) output of control computer 50 via signal path 106. An output of the driver circuit 104 is electrically connected to an illumination device 108 via signal path 110, wherein the illumination device 108 may be a lamp, light emitting diode (LED) or other suitable illumination device. In any case, the driver circuit 104 is responsive to a control signal produced by control computer 50 at its MIL output to control operation; i.e., activate and deactivate, the illumination device 108.

Figure 2:
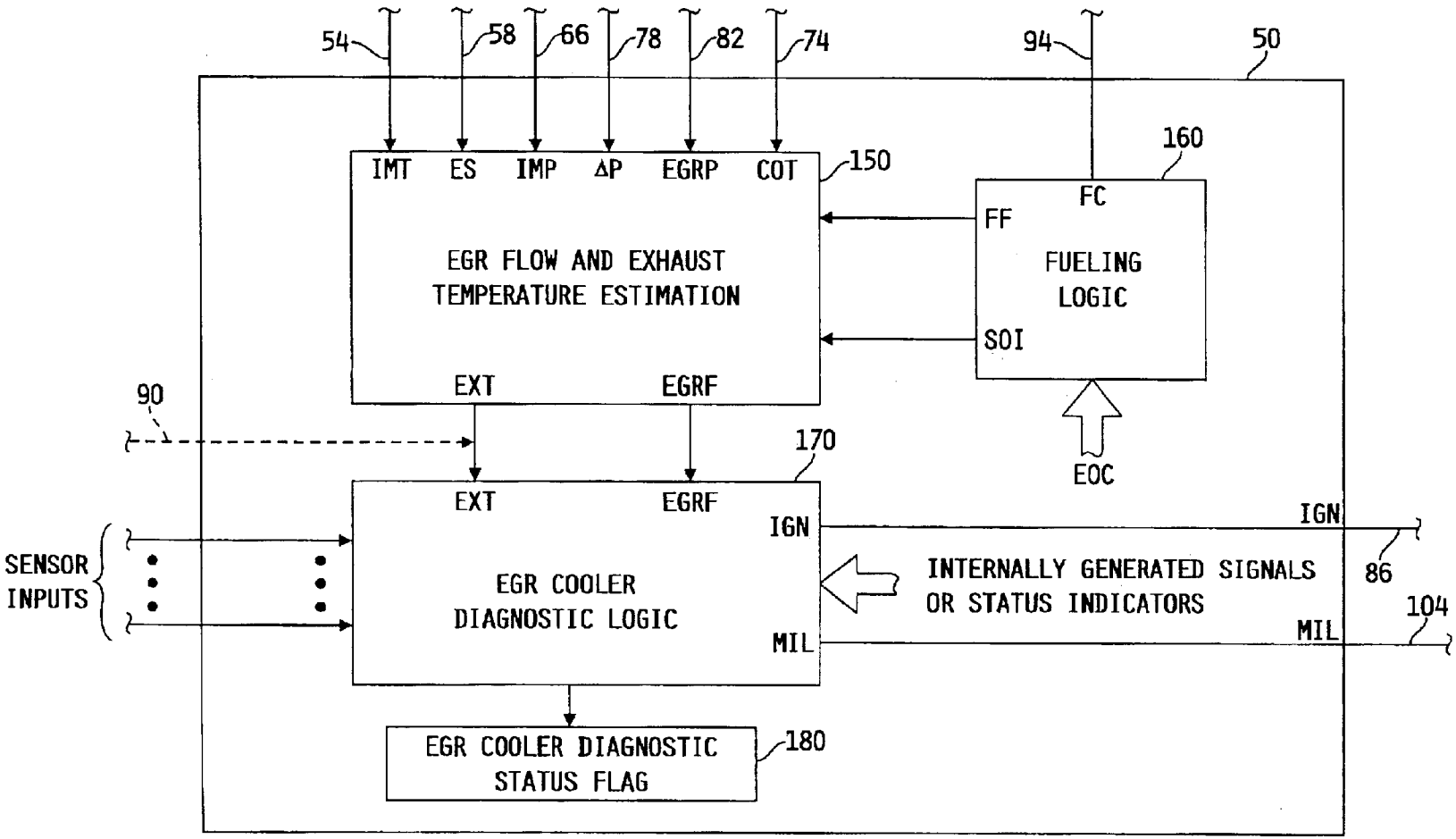
FIG. 2 is a block diagram of one illustrative configuration of some of the internal features of the control computer of FIG. 1 as they relate to the diagnosing operation of the EGR cooler.

Referring now to FIG. 2, a block diagram of one illustrative configuration of some of the internal features of the control computer 50 of FIG. 1, as they relate to the diagnosing operation of the EGR cooler 40, is shown. Control computer 50 includes a fueling determination block 160 receiving as inputs a number of engine operating condition values, EOC, including, for example, engine speed and other engine operating parameters. Block 160 is responsive to the number of engine operating condition values, EOC, to determine a number of fueling parameters, including a mass fuel flow rate value, FF, and a start-of-fuel injection timing value, SOI, and to compute a fueling command, FC, as a function of these various fueling parameters, in a manner well known in the art. The fueling determination block 160 is operable to provide the fueling command, FC, on signal path 94, and the fueling system 92 is responsive to the fueling command, FC, to supply fuel to engine 12 as described hereinabove.

Control computer 50 further includes an EGR flow and exhaust temperature estimation block 150 having an intake manifold temperature input, IMT, receiving the intake manifold temperature signal on signal path 54, an engine speed input, ES, receiving the engine speed signal on signal path 58, an intake manifold pressure input, IMP, receiving the intake manifold pressure signal on signal path 66, a delta pressure input, ΔP, receiving the delta pressure signal on signal path 78, an EGR valve position input, EGRP, receiving the EGR valve position signal on signal path 82, and an EGR cooler orifice temperature input, COT, receiving the EGR cooler orifice temperature signal on signal path 74. Block 150 also receives as inputs the mass fuel flow rate value, FF, and the start of injection value, SOI, from the fueling logic block. The EGR flow and exhaust temperature estimation block 150 is operable, as will be more fully described hereinafter, to estimate EGR flow rate and provide this estimate at an EGR flow rate output, EGRF, and to estimate exhaust gas temperature and provide this estimate at an exhaust gas temperature output, EXT, of block 150.

Control computer 50 further includes an EGR cooler diagnostic logic block 170 having an EGR flow rate input, EGRF, receiving the estimated EGR flow rate value produced by block 150, and an exhaust gas temperature input, EXT, receiving an exhaust gas temperature value. In one embodiment, the exhaust gas temperature input, EXT, of the EGR cooler diagnostic logic block 170 receives the estimated exhaust gas temperature value produced by block 150. In embodiments of system 10 including an exhaust gas temperature sensor 88, the exhaust gas temperature input, EXT, of the EGR cooler diagnostic block 170 may alternatively receive the exhaust gas temperature signal produced by sensor 88. In any case, block 170 further includes an ignition input, IGN, receiving the ignition signal produced by the ignition switch 84, as well as a number of sensor inputs receiving signals produced by various ones of the sensors illustrated in system 10 of FIG. 1, as will be described in greater detail hereinafter. Further still, block 170 includes a number of inputs receiving information generated internally to the control computer 50, including internally generated signals or status indicators, as will be described in greater detail hereinafter. Block 170 further includes a malfunction indicator lamp output, MIL, producing a control signal on signal path 104.

The EGR cooler diagnostic logic block 170 is operable, as will be described in greater detail hereinafter, to diagnose operation of the EGR cooler 40 as a function of EGR flow, exhaust gas temperature and other information relating to the operation of system 10. Control computer 50 further includes an EGR cooler diagnostic status flag 180, wherein the EGR cooler diagnostic logic block 170 is operable to control the status of this flag as well as the operation of the malfunction indicator lamp 108, as will be described hereinafter.

In the embodiment illustrated in FIG. 2, the EGR flow and exhaust gas temperature estimation block 150 is operable to estimate as a function of current engine operating conditions the EGR flow rate and exhaust gas temperature. In one embodiment, the EGR flow and exhaust gas temperature estimation block 150 is operable to estimate the EGR flow rate, EGRF, as a function of the pressure differential value, ΔP, the intake manifold pressure, IMP, the EGR cooler orifice temperature, COT, and an effective flow area, EFA, corresponding to the cross-sectional flow area defined through EGR conduits 38A, 38B and 48. In the embodiment illustrated in FIGS. 1 and 2, the EGR flow and exhaust temperature estimation block 150 is operable to compute the effective flow area value, EFA, as a function of the EGR valve position signal, EGRP. In such embodiments, block 150 may include one or more equations, graphs and/or tables relating EGR position values, EGRP, to effective flow area values, EFA. In any case, block 150 is operable to estimate the EGR flow value, EGRF according to the equation:

$$EGRF=EFA*\mathrm{sqrt}[|(2*\Delta P*IMP)/(R*COT)|] \quad (1),$$

where,

EFA is the effective flow area through EGR conduits 38A, 38B and 48, ΔP is the pressure differential across EGR valve 36, IMP is the intake manifold pressure.

R is a known gas constant (e.g., R=53.3 ft-lbf/lbm ° R or R=287 J/Kg ° K), and

COT is the EGR cooler orifice temperature.

Further details relating the foregoing EGR flow rate estimation technique, as well as other suitable EGR flow rate estimation techniques, are described in co-pending U.S. patent application Ser. No. 09/774,897, entitled SYSTEM AND METHOD FOR ESTIMATING EGR MASS FLOW AND EGR FRACTION, which is assigned to the assignee of the present invention, and the disclosure of which is incorporated herein by reference. Those skilled in the art will recognize that other known techniques may be used to estimate or otherwise determine the EGR flow rate value, EGRF. For example, system 10 may include a CO or $CO_2$ sensor of known construction and fluidly coupled to intake manifold 14 or intake conduit 20 downstream of the junction of intake conduit 20 with the EGR conduit 48. Such a CO or $CO_2$ sensor will be operable to produce a signal indicative of CO or $CO_2$ level of air charge entering the intake manifold 14, and such information may be used to determine the EGR flow rate value, EGRF, using known equations. As another example, any of the EGR conduits 38A, 38B or 48 may have a mass flow rate sensor in fluid communication therewith, wherein the EGR flow rate may be determined directly from information provided by such a sensor. As yet another example, the control computer 50 may include other EGR flow rate estimation algorithms, such as one or more the algorithms described in the above-referenced document, wherein control computer 50 may be operable to estimate the EGR flow rate according to one or more such alternative EGR flow rate estimation strategies. Any and all such alternative EGR flow rate determination techniques and strategies are intended to fall within the scope of the claims appended hereto.

The EGR flow and exhaust temperature estimation block 150 is further operable to compute an estimate of the engine exhaust temperature, EXT, based on current engine operating conditions. In one embodiment, block 150 is configured to estimate EXT according to the equation:

$$EXT=IMT+[(A*ES)+(B*IMP)+(C*SOI)+D)][(LHV*FF)/CF] \quad (2),$$

where,

IMT is the intake manifold temperature,

ES is the engine speed,

IMP is the intake manifold pressure,

SOI is the start of injection value produced by fueling logic block 160,

FF is the fuel flow value produced by fueling logic block 160,

CF is the mass flow rate of charge entering the intake manifold 14,

LHV is a lower heating value of the fuel which is a known constant depending upon the type of fuel used by engine 12, and A, B, C, and D are model constants.

In an alternate embodiment, block 150 may be operable to compute the engine exhaust temperature estimate, EXT, according to the equation:

$$EXT=IMT+A+(B*SOI)+C/(CF/FF)+(D*SOI)/ES+E/[(ES*CF)/FF] \quad (3),$$

where,

IMT is the intake manifold temperature,

ES is the, engine speed,

SOI is the start of injection value produced by fueling logic block 160,

FF is the fuel flow value produced by fueling logic block 160,

CF is the charge mass flow rate, and

A, B, C, and D are model constants.

Estimation of the exhaust gas temperature, EXT, according to either of equations (2) or (3) requires a determination of the mass flow of charge entering the intake is manifold 14, or charge flow value, CF, wherein the term "charge" has been defined herein as a combination of fresh air entering the intake conduit 20 and recirculated exhaust gas provided by the EGR handling system comprising EGR valve 36, EGR cooler 40 and EGR conduits 38A, 38B and 48. In the illustrated embodiment, block 150 is operable to estimate the charge flow value, CF, by first estimating the volumetric efficiency ($\eta_V$) of the charge intake system, and then computing CF as a function of $\eta_V$ using a conventional speed/density equation. Any known technique for estimating $\eta_V$ may be used, and in one preferred embodiment of block 150, $\eta_V$ is computed according to a known Taylor mach number-based volumetric efficiency equation given as:

$$\eta_V=A_1*\{(\mathrm{Bore}/D)^2*(\mathrm{stroke}*ES)^{\beta}/\mathrm{sqrt}(\gamma*R*IMT)*[(1+EP/IMP)+A_2]\}+A_3 \quad (4),$$

where,

A1, $A_2$, $A_3$ and B are all calibratable parameters fit to the volumetric efficiency equation based on mapped engine data, Bore is the intake valve bore length, D is the intake valve diameter, stroke is the piston stroke length, wherein Bore, D and stroke are dependent upon engine geometry, γand R are known constants (e.g., γ*R=387.414 J/kg/deg K), ES is engine speed, IMP is the intake manifold pressure, EP is the exhaust pressure, where EP=IMP+ΔP, and IMT=intake manifold temperature.

With the volumetric efficiency value $\eta_V$ estimated according to the foregoing equation, block 150 is operable to compute the charge flow value, CF, according to the equation:

$$CF=\eta_V*V_{DIS}*ES*IMP/(2*R*IMT) \quad (5),$$

where, $\eta_V$ is the estimated volumetric efficiency, $V_{DIS}$ is engine displacement and is generally dependent upon engine geometry, ES is engine speed, IMP is the intake manifold pressure, R is a known gas constant (e.g., R=53.3 ft-lbf/lbm ° R or R=287 J/Kg ° K), and IMT is the intake manifold temperature.

Those skilled in the art will recognize that the charge flow value, CF, may alternatively be computed or otherwise determined according to other known techniques. For example, system 10 may optionally include a mass flow sensor disposed in fluid communication with the intake manifold 14 or intake conduit 20 downstream of the junction of conduit 20 and EGR conduit 48, wherein control computer 50 may be configured in a known manner to determine charge flow values directly from information provided by such a mass flow sensor. As another example, control computer 50 may be configured to estimate the charge flow value, CF, according to one or more known charge flow estimation techniques. Any such alternate mechanisms and/or techniques for determining the charge flow value, CF, are intended to fall within the scope of the claims appended hereto.

In any case, with the charge flow value, CF, determined according to any of the foregoing techniques, control computer 50 is operable to estimate the exhaust gas temperature, EXT, according to either of the equations (2) or (3). Further details relating to either of the engine exhaust temperature models represented by equations (2) and (3) are provided in U.S. Patent No. 6,508,242, entitled SYSTEM FOR ESTIMATING ENGINE EXHAUST TEMPERATURE, which is assigned to the assignee of the present invention, and the disclosure of which is incorporated herein by reference. Those skilled in the art will recognize that the exhaust gas temperature value, EXT, may alternatively be computed or otherwise determined according to other known techniques. For example, system 10 may optionally include the exhaust gas temperature sensor 88 illustrated in phantom in FIG. 1, wherein control computer 50 may be configured in a known manner to determine exhaust gas temperature information directly from information provided by sensor 88. As another example, control computer 50 may be configured to estimate the exhaust gas temperature, EXT, according to one or more known exhaust gas temperature estimation techniques. Any such alternate mechanisms and/or techniques for determining the exhaust gas temperature value, EXT, are intended to fall within the scope of the claims appended hereto.

The EGR cooler diagnostic logic block 170 is operable to diagnose EGR cooler fouling based on an EGR cooler effectiveness parameter or ratio, R, which is defined according to the equation:

$$R=(EXT-COT)/(EXT-CT) \quad (6),$$

where,

EXT is the engine exhaust gas temperature,

COT is the EGR cooler orifice temperature, and

CT is the engine coolant temperature.

It has been determined that the EGR cooler effectiveness ratio, R, has a strong correlation with EGR flow rate, such that as EGR flow increases the EGR cooler effectiveness ratio decreases within a range of ratio values. For a fouled EGR cooler 40, the EGR cooler effectiveness ratio, R, is discernibly lower than that for a normally functioning EGR cooler 40 and accordingly deviates from the range of ratio values for a normally functioning EGR cooler Referring to FIG. 4, for example, a plot of the EGR cooler effectiveness ratio, R, vs. EGR flow rate is shown wherein the cluster of data points 260 represent the operation of a normally functioning EGR cooler 40 while the cluster of data points 270 represent the operation of a fouled EGR cooler 40. The EGR cooler diagnostic logic block 170 is operable to diagnose operation of the EGR cooler 40 based on the EGR cooler effectiveness parameter or ratio R, and on the relationship between R and the EGR flow rate, EGRF.

Figure 3A:
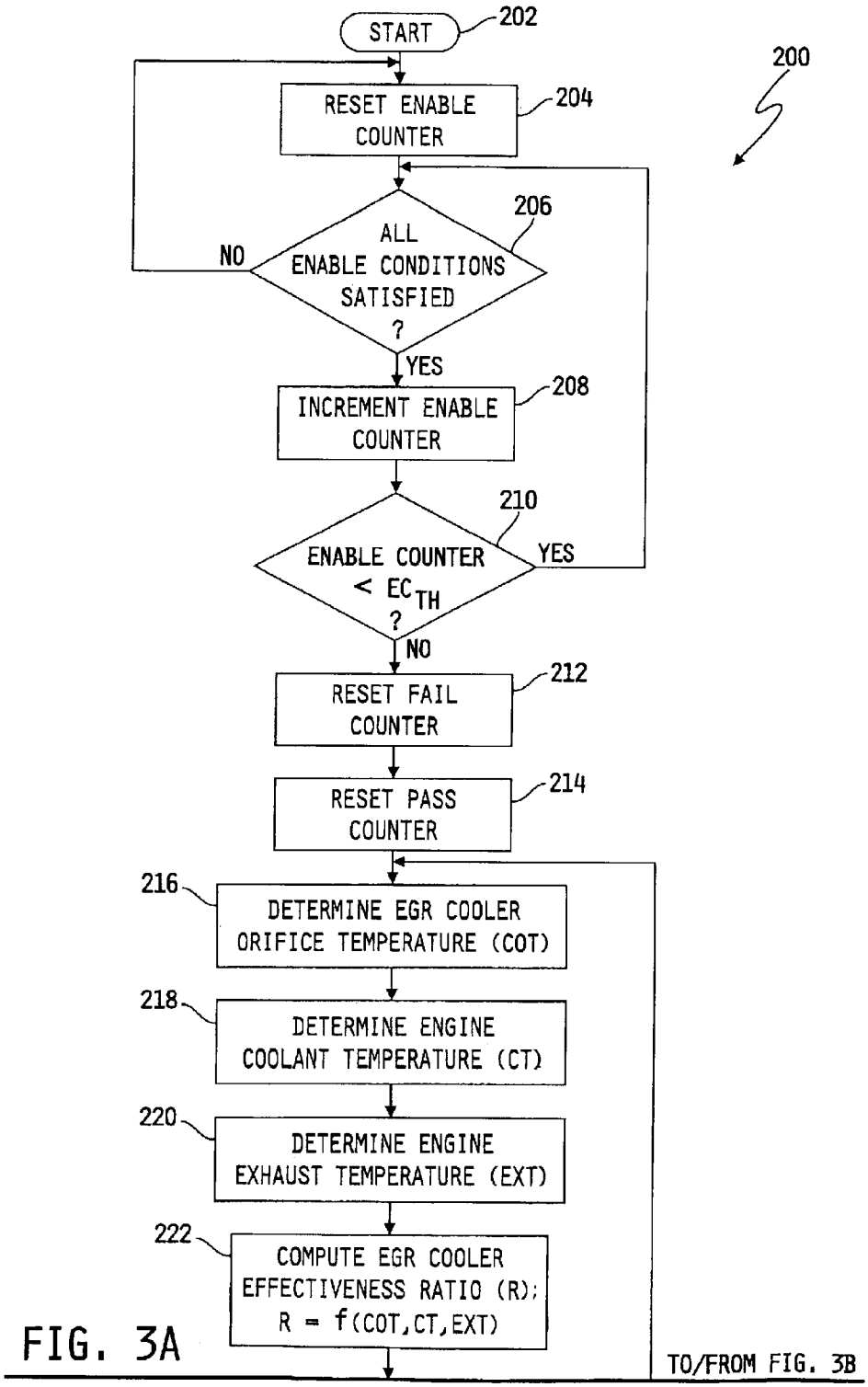
FIGS. 3A and 3B represent a flowchart of one illustrative embodiment of a software algorithm for diagnosing operation of an EGR cooler using the system illustrated in FIGS. 1 and 2.
Figure 3B:
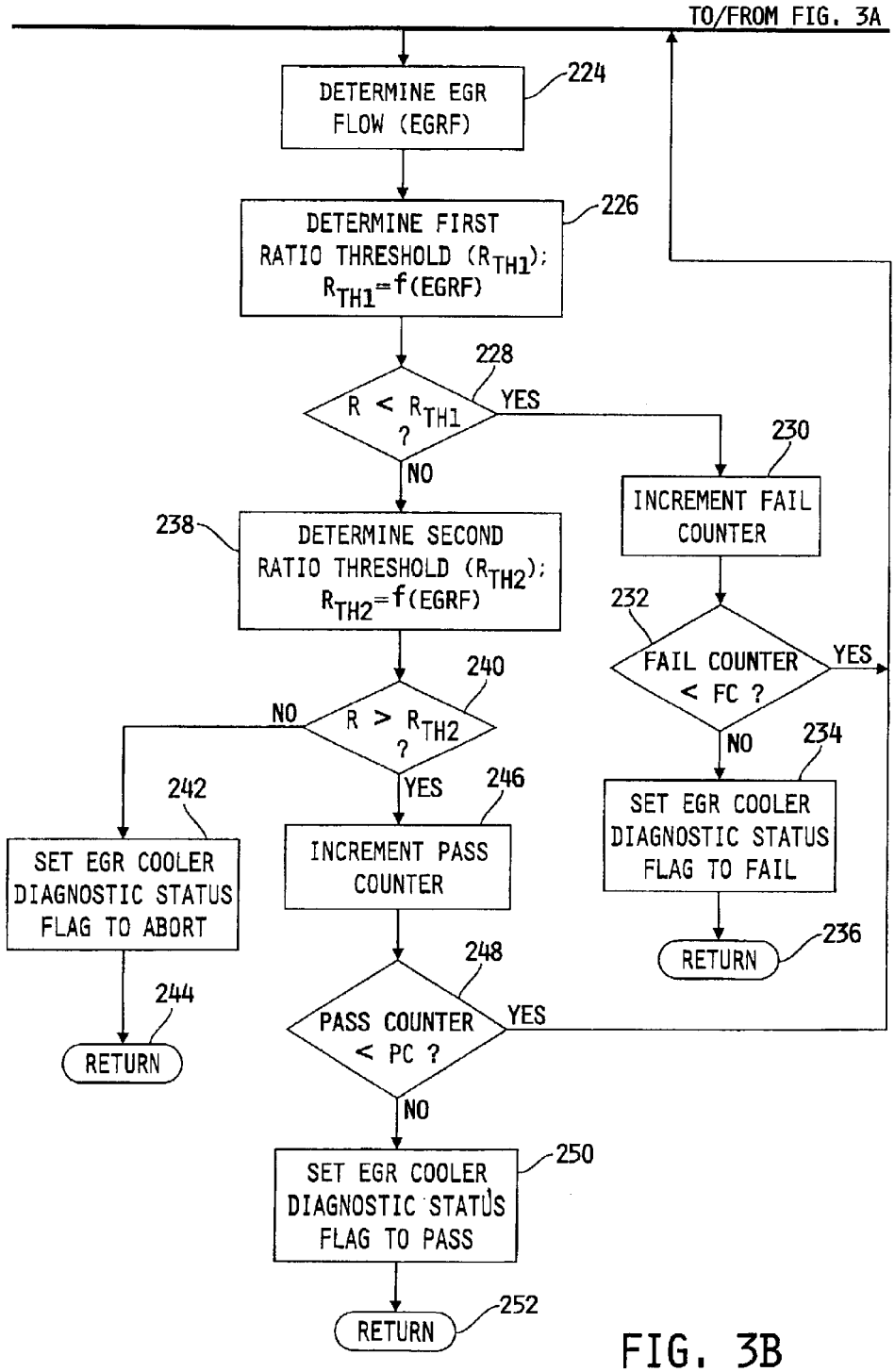

Referring now to FIGS. 3A and 3B, a flowchart is shown illustrating one embodiment of a software algorithm 200 for diagnosing operation of the EGR cooler 40 using the system illustrated in FIGS. 1 and 2. In one embodiment, algorithm 200 is stored within the EGR cooler fouling diagnostic block 170 of control computer 150, and is in any case executed by control computer 150. Algorithm 200 begins at step 202, and thereafter at step 204 control computer 50 is operable to reset an enable counter. Thereafter at step 206, control computer 50 is operable to determine whether all EGR cooler fouling diagnostic enable conditions are satisfied. In one embodiment, control computer 50 is operable to execute step 206 by monitoring the engine and system sensor operating conditions set forth in the following Table 1, and comparing these various engine and system sensor operating conditions to their corresponding parameter thresholds, ranges or conditions also set forth in Table 1. If all of these enabling conditions are satisfied, algorithm execution advances to step 208, and otherwise it loops back to step 204.

TABLE 1

| Engine Operating Parameter | Enabling Threshold, Range or Condition |
|---|---|
| All system sensors | no supply voltage out-of-range fault |
| Intake manifold pressure sensor | no in-range sensor fault |
| Intake manifold temperature sensor | no sensor rationality fault |
| ΔP sensor | no out-of-range or rationality faults |
| EGR orifice temperature sensor | no out-of-range or rationality faults |
| EGR valve position sensor | no out-of-range or rationality faults |
| Coolant temperature sensor | no in-range or out-of-range faults |
| EGR and VGT control circuits and mechanisms | no EGR/VGT control functionality or drive circuit faults |
| Power Take Off Status | Inactive |
| Engine operating state | Run |
| Coolant temperature (CT) | $CT > CT_{TH}$ |
| Battery voltage (BV) | $BV_L < BV < BV_H$ |
| Ambient air temperature (AT) | $AT_L < AT < AT_H$ |
| Engine speed (ES) | $ES_L < ES < ES_H$ |

In Table 1, the first seven conditions relate to in-range, out-of-range and/or rationality faults, all of which are conventional sensor fault conditions that are commonly understood by those skilled in the art. In one embodiment, control computer 50 includes sensor monitoring circuitry and/or software (not shown) for monitoring such sensor fault conditions, and in this embodiment the corresponding in-range, out-of-range and rationality fault information forms part of the internally generated signals or status indicators provided to the EGR cooler diagnostic block 170 as illustrated in FIG. 2. Alternatively, the EGR cooler diagnostic block 170 may include sensor diagnostic software, and in this embodiment the signals produced by all of the sensors in system 10 are provided to block 170 via the sensor inputs illustrated in FIG. 2.

The EGR/VGT control functionality or drive circuit faults relate to the operation of the EGR valve and VGT control mechanisms described hereinabove, and in one embodiment control computer 50 includes circuitry and/or software (not shown) for monitoring such EGR and VGT control mechanism fault conditions, and in this embodiment the corresponding EGR/VGT control functionality or drive circuit fault information forms part of the internally generated signals or status indicators provided to the EGR cooler diagnostic block 170 as illustrated in FIG. 2. Alternatively, the EGR cooler diagnostic block 170 may include EGR/VGT control mechanism diagnostic software, and in this embodiment signals provided by EGR/VGT control mechanism diagnostic sensors or other fault detection circuitry are provided to block 170 via the sensor inputs illustrated in FIG. 2.

System 10 may further include conventional power take off (PTO) system (not shown) that may be used to operate the engine at one or more specified engine speeds and/or to operate conventional PTO machinery. In one embodiment, control computer 50 includes circuitry and/or software (not shown) for monitoring the operational status of the PTO system, and in this embodiment the PTO status information forms part of the internally generated signals or status indicators provided to the EGR cooler diagnostic block 170 as illustrated in FIG. 2. Alternatively, the EGR cooler diagnostic block 170 may include PTO system monitoring software, and in this embodiment signals produced by PTO operational switches or other PTO control devices are provided to block 170 via the sensor inputs illustrated in FIG. 2.

The control computer 50 maintains a flag or other indicator of the operating state of the engine in a conventional manner, wherein the status of such a flag or other indicator reflects the operational state; i.e., "run" or "stop", of the engine 12. In one embodiment, control computer 50 includes circuitry and/or software for monitoring the operational state of the engine 12, and in this embodiment the engine operating state flag or other indicator forms part of the internally generated signals or status indicators provided to the EGR cooler diagnostic block 170 as illustrated in FIG. 2. Alternatively, the EGR cooler diagnostic block 170 may include engine operating state monitoring software, and in this embodiment signals produced by the key switch 84 and/or engine speed sensor 56 and/or other sensors or switches from which the engine operating state may determined are provided to block 170 via the sensor inputs illustrated in FIG. 2.

The remaining diagnostic enabling conditions set forth in Table 1 represent specified operating ranges of certain engine and/or system operating parameters. For example, the coolant temperature, CT, must be greater than a coolant temperature threshold, $CT_{TH}$. In one embodiment, $CT_{TH}$ is set at a temperature that is indicative of a typical post-warm up engine operating temperature, although it is contemplated that $CT_{TH}$ may be set at other desired temperature levels. As another example, the voltage, BV, produced by the vehicle battery (not shown) must be in a range between a low battery voltage, $BV_L$, and a high battery voltage, $BV_H$. In one embodiment, $BV_L$ and $BV_H$ are set at voltage levels representing extremes at which the control computer 50 is designed to operate, although it is contemplated that $BV_L$ and $BV_H$ may alternatively be set at other desired battery voltage levels. As a further example, the ambient temperature, AT, must be in a range between a low ambient temperature, $AT_L$, and a high ambient temperature, $AT_H$. In one embodiment, $AT_L$ and $AT_H$ define an ambient temperature range in which the results of the EGR cooler diagnostic may be considered reliable, although it is contemplated that $AT_L$ and $AT_H$ may alternatively be set at other desired ambient temperature levels. As yet another example, the engine speed, ES, must be in a range between a low engine speed, $ES_L$, and a high engine speed, $ES_H$. In one embodiment, $ES_L$ and $ES_H$ define an engine speed range indicative of the engine operating at a level sufficient to maintain the coolant temperature, CT, above the coolant temperature threshold, $CT_{TH}$, although it is contemplated that $ES_L$ and $ES_H$ may alternatively be set at other desired engine speed levels. In each of these cases, the engine and/or system operating information is provided to block 170 via the sensor inputs illustrated in FIG. 2.

Those skilled in the art will recognize that Table 1 represents only one illustrative collection of EGR cooler fouling diagnostic enabling conditions, and that this collection may alternatively exclude some of the listed conditions and/or include other engine and/or system operating condition that are not listed in Table 1. Any such alternate collection of enabling conditions will typically be dictated by the application and/or desired accuracy of the diagnostic algorithm, and is in any case intended to fall within the scope of the claims appended hereto.

Referring again to FIG. 3A, control computer 50 is operable to increment the enable counter at step 208 if it was determined at step 206 that all of the enable conditions were satisfied. Thereafter at step 210, control computer 50 compares the count value of the enable counter to an enable counter threshold, $EC_{TH}$. If the count value of the enable counter is less than the threshold, $EC_{TH}$, algorithm execution loops back to step 206. If, on the other hand, control computer 50 determines at step 210 that the count value of the enable counter has reached the enable counter threshold, $EC_{TH}$, algorithm execution advances to step 212.

At step 212, control computer 50 is operable to reset a fail counter, and thereafter at step 214 to reset a pass counter. At steps 216, 218 and 220, control computer 50 is operable to determine current values of the EGR cooler orifice temperature, COT, engine coolant temperature, CT and engine exhaust gas temperature, EXT, according to any of the techniques described hereinabove. Thereafter at step 222, control computer 50 is operable to compute the EGR cooler effectiveness ratio, R, as a function of COT, CT and EXT, and in one embodiment, control computer 50 is operable to execute step 222 by determining R according to equation (6) described hereinabove. Thereafter at step 224 (FIG. 3B), control computer 50 is operable to determine a current value of the EGR flow rate, EGRF, according to any of the techniques described hereinabove.

Figure 4:
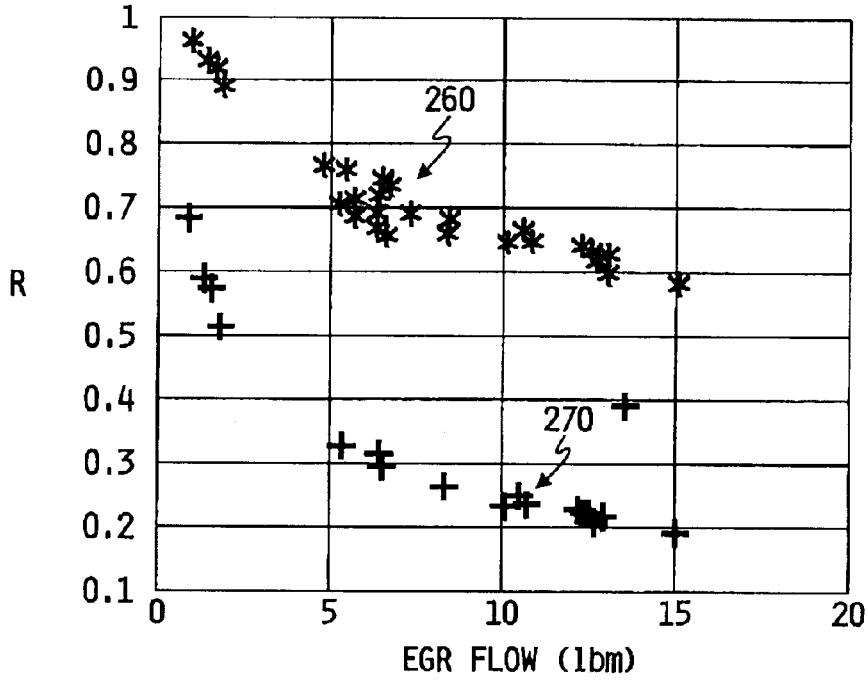
FIG. 4 is a plot of EGR cooler effectiveness ratio vs. EGR flow illustrating the correlation therebetween.
Figure 5:
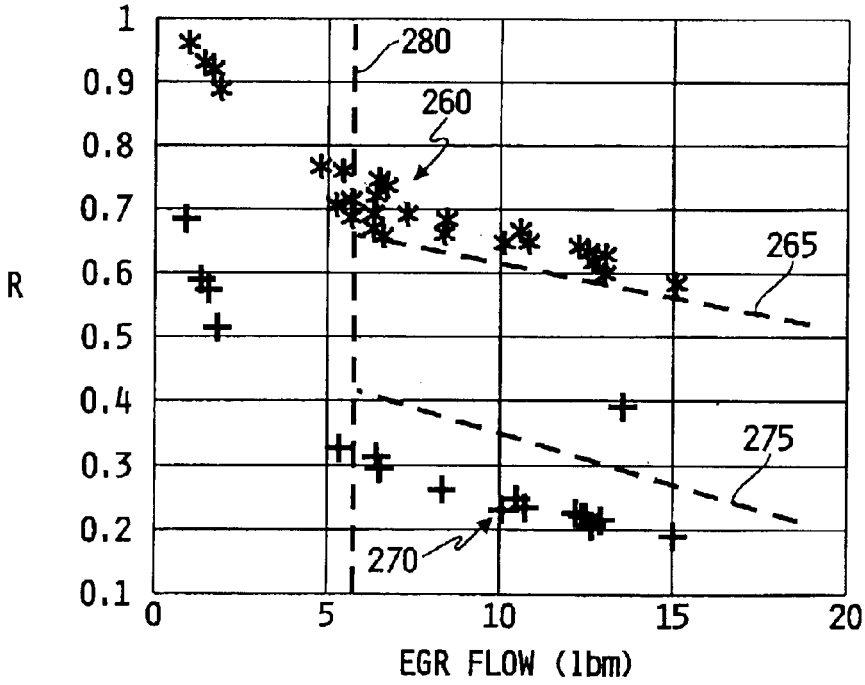
FIG. 5 is a plot of EGR cooler effectiveness ratio vs. EGR flow illustrating determination of EGR cooler effectiveness ratio thresholds as a function of EGR flow.

Following step 224, control computer 50 is operable at step 226 to determine a first EGR cooler effectiveness ratio threshold value, $R_{TH1}$, as a function of the EGR flow rate, EGRF. As described hereinabove with respect to FIG. 4, it has been determined that the EGR cooler effectiveness ratio, R, has a strong correlation with the EGR flow rate, EGRF. In one embodiment of algorithm 200, this correlation between R and EGRF is used to define $R_{TH1}$ as a function of current EGRF values. Referring to FIG. 5, for example, the R vs. EGRF plot of FIG. 4 is again illustrated with the cluster of data points 260 representing the operation of a normally functioning EGR cooler 40 while the cluster of data points 270 represent the operation of a fouled EGR cooler 40. It can be seen from FIG. 5 that for EGR flow rates in excess of approximately 6 lbm, corresponding to dashed vertical line 280, both of the dusters 260 and 270 of data points representing the EGR cooler effectiveness ratio, R, can be approximated as a first order function of EGR flow rate, EGRF. Accordingly, as illustrated in FIG. 5, a linear relationship 275 between R and EGRF is established relative to the cluster of data points 270 such that EGR cooler effectiveness ratio values, R, that lie below line 275 are indicative of a fouled EGR cooler 40. The first EGR cooler effectiveness ratio threshold, $R_{TH1}$, is thus defined in the illustrated embodiment by line 275 as a first order function of EGR flow rate, EGRF. The function defining $R_{TH1}$ may be stored in the EGR cooler diagnostic logic block 170 in equation, table, graph or other form relating $R_{TH1}$ to EGRF. Those skilled in the art will recognize that $R_{TH1}$ may alternatively be defined as a higher order function of EGRF, or alternatively still using any known data fitting technique, such that $R_{TH1}$ more accurately tracks the R vs. EGR cluster of data points 270 over any desired range of R and/or EGRF, and any such alternate definition of $R_{TH1}$ is intended to fall within the scope of the claims appended hereto. In any case, it is desirable to select $R_{TH1}$ relative to the R vs. EGRF relationship such that values of R that lie below $R_{TH1}$ are indicative of a fouled EGR cooler 40.

Returning to FIG. 3B, control computer 50 is operable at step 226 to determine the first EGR cooler effectiveness ratio threshold value, $R_{TH1}$, as a function of the current EGR flow rate, EGRF, according to any of the techniques just described. Thereafter at step 228, control computer 50 is operable to compare the EGR cooler effective ratio, R, that was determined at step 222 to $R_{TH1}$. If control computer 50 determines at step 228 that R is less than $R_{TH1}$, algorithm execution advances to step 230 where control computer 50 increments the fail counter. Thereafter at step 232, control computer 50 compares the count value of the fail counter to a fail count value, FC, and if the count value of the fail counter is less than FC algorithm execution loops back to step 216 (FIG. 3A). If, on the other hand, control computer 50 determines at step 232 that the count value of the fail counter is equal to the fail count value, FC, algorithm execution advances to step 234 where control computer 50 is operable to set the EGR cooler diagnostic status flag to FAIL, and thereafter to step 236 where algorithm execution is returned to its calling routine.

If, at step 228, control computer 50 determines that the current value of the EGR cooler effectiveness ratio, R, is greater than or equal to the first EGR cooler effectiveness ratio threshold value, $R_{TH1}$, algorithm execution advances to step 238 where control computer 50 is operable to determine second EGR cooler effectiveness ratio threshold value, $R_{TH2}$, as a function of the EGR flow rate, EGRF. In one embodiment of algorithm 200, the correlation between R and EGRF illustrated in FIGS. 4 and 5 is used to define $R_{TH2}$ as a function of current EGRF values. Referring again to FIG. 5, for example, a linear relationship 265 between R and EGRF is established relative to the cluster of data points 260 such that EGR cooler effectiveness ratio values, R, that lie above line 265 are indicative of a normally functioning EGR cooler 40. The second EGR cooler effectiveness ratio threshold, $R_{TH2}$, is thus defined in the illustrated embodiment by line 265 as a first order function of EGR flow rate, EGRF. The function defining $R_{TH2}$ may be stored in the EGR cooler diagnostic logic block 170 in equation, table, graph or other form relating $R_{TH2}$ to EGRF. Those skilled in the art will recognize that, as with $R_{TH1}$, $R_{TH2}$ may alternatively be defined as a higher order function of EGRF, or alternatively still using any known data fitting technique, such that $R_{TH2}$ more accurately tracks the R vs. EGR cluster of data points 260 over any desired range of R and/or EGRF, and any such alternate definition of $R_{TH2}$ is intended to fall within the scope of the claims appended hereto. In any case, it is desirable to select $R_{TH2}$ relative to the R vs. EGRF relationship such that values of R that lie above $R_{TH2}$ are indicative of a normally functioning EGR cooler 40.

Returning again to FIG. 3B, control computer 50 is operable at step 238 to determine the second EGR cooler effectiveness ratio threshold value, $R_{TH2}$, as a function of the current EGR flow rate, EGRF, according to any of the techniques just described. Thereafter at step 240, control computer 50 is operable to compare the EGR cooler effectiveness ratio, R, that was determined at step 222, to $R_{TH2}$. If control computer 50 determines at step 228 that R is less than or equal to $R_{TH2}$, such that R lies between $R_{TH1}$ and $R_{TH2}$, algorithm execution advances to step 242 where control computer 50 is operable to set the EGR cooler diagnostic status flag to ABORT, and thereafter to step 244 where algorithm execution is returned to its calling routine. If, on the other hand, control computer 50 determines at step 240 that R is greater than $R_{TH2}$, algorithm execution advances to step 246 where control computer 50 increments the pass counter. Thereafter at step 248, control computer 50 compares the count value of the pass counter to a pass count value, PC, and if the count value of the pass counter is less than PC algorithm execution loops back to step 216 (FIG. 3A). If, on the other hand, control computer 50 determines at step 248 that the count value of the pass counter is equal to the pass count value, PC, algorithm execution advances to step 250 where control computer 50 is operable to set the EGR cooler diagnostic status flag to PASS, and thereafter to step 252 where algorithm execution is returned to its calling routine.

Figure 6A:
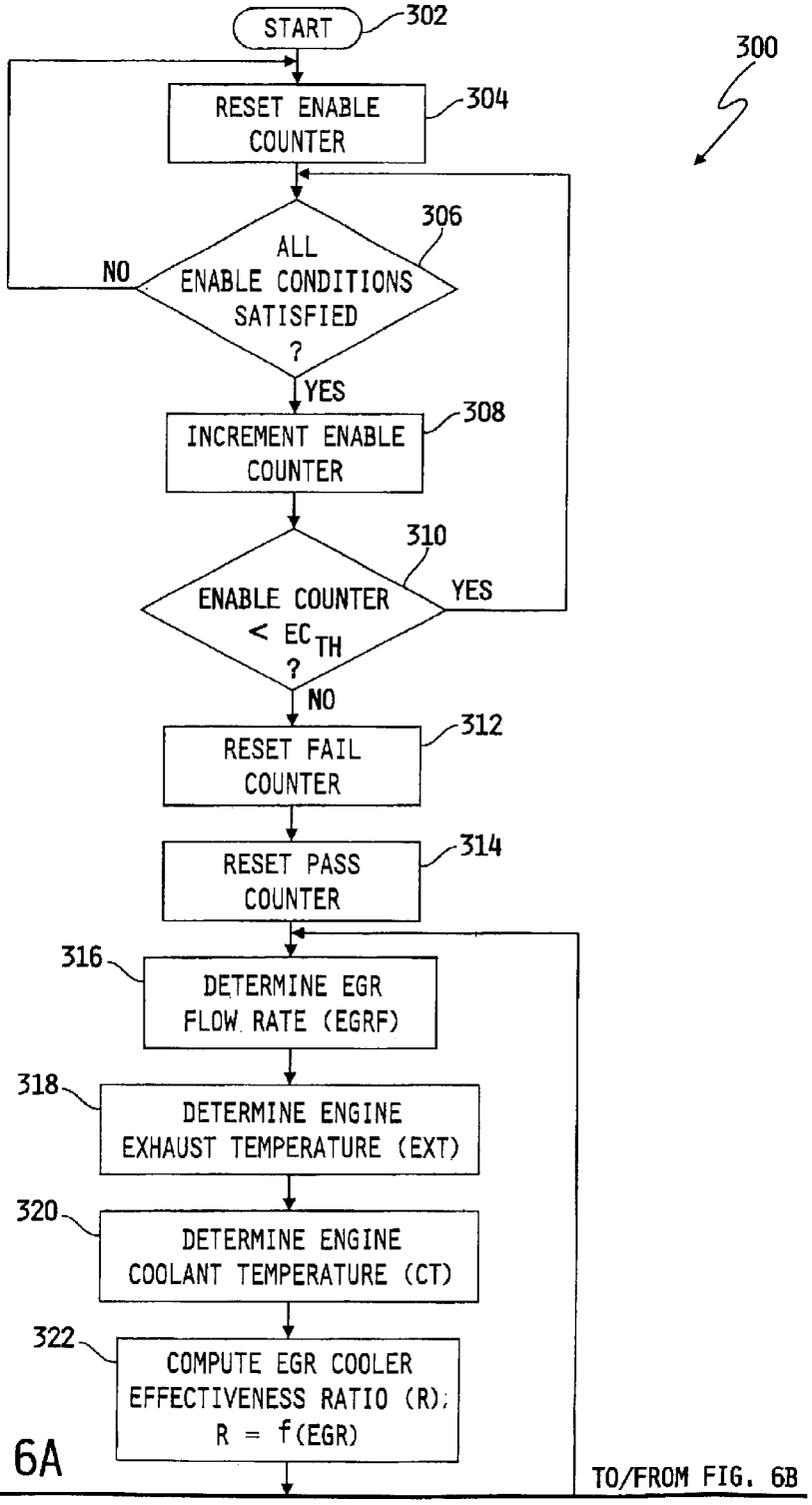
FIGS. 6A and 6B represent a flowchart of another illustrative embodiment of a software algorithm for diagnosing the operation of an EGR cooler using the system illustrated in FIGS. 1 and 2.
Figure 6B:
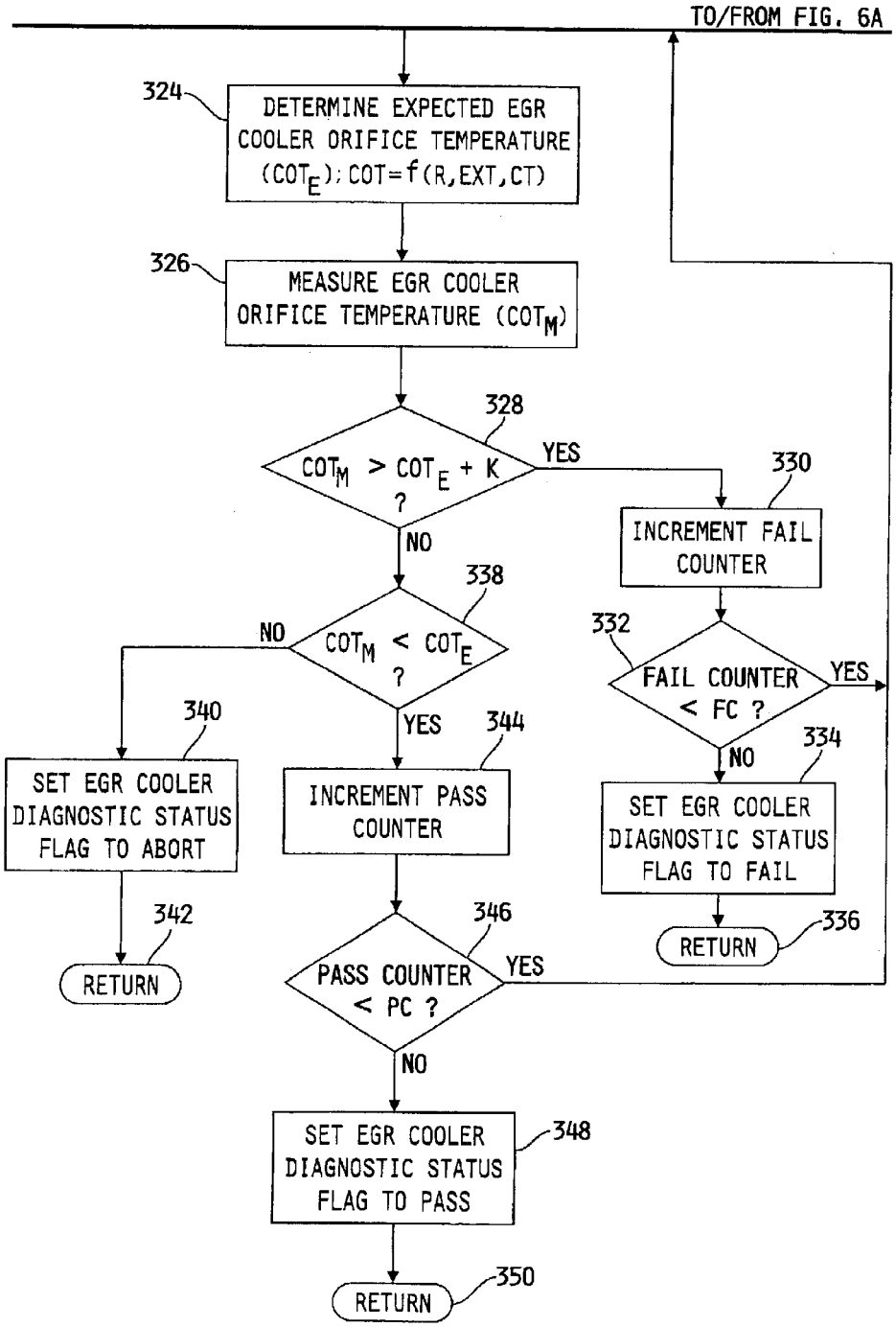

Referring now to FIGS. 6A and 6B, a flowchart is shown illustrating another embodiment of a software algorithm 300 for diagnosing operation of the EGR cooler 40 using the system illustrated in FIGS. 1 and 2. In one embodiment, algorithm 300 is stored within the EGR cooler fouling diagnostic block 170 of control computer 150, and is in any case executed by control computer 150. Algorithm 300 begins at step 302, and thereafter at step 304 control computer 50 is operable to reset an enable counter. Thereafter at step 306, control computer 50 is operable to determine whether all EGR cooler fouling diagnostic enable conditions are satisfied. In one embodiment, control computer 50 is operable to execute step 306 by monitoring the engine and system sensor operating conditions set forth in Table 1 above, and comparing these various engine and system sensor operating conditions to their corresponding parameter thresholds, ranges or conditions also set forth in Table 1. If all of these enabling conditions are satisfied, algorithm execution advances to step 308, and otherwise it loops back to step 304.

As described hereinabove, those skilled in the art will recognize that Table 1 represents only one illustrative collection of EGR cooler fouling diagnostic enabling conditions, and that this collection may alternatively exclude some of the listed conditions and/or include other engine and/or system operating condition that are not listed in Table 1. Any such alternate collection of enabling conditions will typically be dictated by the application and/or desired accuracy of the diagnostic algorithm, and is in any case intended to fall within the scope of the claims appended hereto.

Control computer 50 is operable to increment the enable counter at step 308 if it was determined at step 306 that all of the enable conditions were satisfied. Thereafter at step 310, control computer 50 compares the count value of the enable counter to an enable counter threshold, $EC_{TH}$. If the count value of the enable counter is less than the threshold, $EC_{TH}$, algorithm execution loops back to step 306. If, on the other hand, control computer 50 determines at step 310 that the count value of the enable counter has reached the enable counter threshold, $EC_{TH}$, algorithm execution advances to step 312.

At step 312, control computer 50 is operable to reset a fail counter, and thereafter at step 314 to reset a pass counter. At steps 316, 318 and 320, control computer 50 is operable to determine current values of the EGR flow rate, EGRF, engine exhaust gas temperature, EXT, and engine coolant temperature, CT according to any of the techniques described hereinabove. Thereafter at step 322, control computer 50 is operable to compute the EGR cooler effectiveness ratio, R, as a function of EGR flow rate, EGRF. In one embodiment, control computer 50 is operable to execute step 322 by mapping the current EGR flow rate, EGRF, to an EGR cooler effectiveness ratio value, R, via one or more equations, look-up tables, graphs, or the like defining R as a function of EGRF. Using the relationship between the EGR cooler effectiveness ratio, R, and EGR flow rate, EGRF, as illustrated in FIG. 4, for example, the EGR, cooler effectiveness ratio, R, can be modeled as a function of EGRF using any degree polynomial, known data fitting technique or other known parameter modeling technique, to represent R as a function of EGRF. In one specific embodiment, for example, R is modeled as a first order function of EGRF similarly as described with respect FIG. 5 as it relates to determination of the ratio thresholds $R_{TH1}$ and $R_{TH2}$. In any case, control computer 50 is operable at step 322 to compute the EGR effectiveness ratio, R, as a function of the current EGR flow rate, EGRF, according to any of the techniques just described.

Following step 322, algorithm execution advances to step 324 where control computer 50 is operable to determine an expected EGR cooler orifice temperature, $COT_E$, as a function of the EGR cooler effectiveness ratio, R, just computed at step 322, and the exhaust gas temperature and engine coolant temperature values, EXT and CT respectively determined at steps 318 and 320. Control computer 50 is operable to execute step 324 by computing the expected EGR cooler orifice temperature, $COT_E$, according to equation (6) set forth above, e.g., $COT_E$=EXT−[R*(EXT−CT)]. Thereafter at step 326, control computer 50 is operable to measure the EGR cooler orifice temperature by monitoring temperature sensor 72 (see FIG. 1) and determining therefrom a measured EGR cooler orifice temperature value, $COT_M$.

Following step 326, control computer 50 is operable at step 328 to compare the measured EGR cooler orifice temperature, $COT_M$ to the expected EGR cooler orifice temperature, $COT_E$. If, at step 328, $COT_M$ is greater than the sum of $COT_E$ and temperature constant, K, algorithm execution advances to step 330 where control computer 50 increments the fail counter. Thereafter at step 332, control computer 50 compares the count value of the fail counter to a fail count value, FC, and if the count value of the fail counter is less than FC algorithm execution loops back to step 316 (FIG. 6A). If, on the other hand, control computer 50 determines at step 332 that the count value of the fail counter is equal to the fail count value, FC, algorithm execution advances to step 334 where control computer 50 is operable to set the EGR cooler diagnostic status flag to FAIL, and thereafter to step 336 where algorithm execution is returned to its calling routine.

If, at step 328, control computer 50 determines that the measured EGR cooler orifice temperature, $COT_M$ is less than or equal to the sum of the expected EGR cooler orifice temperature, $COT_E$ and a temperature constant, K, algorithm execution advances to step 338 where control computer 50 is operable to again compare the measured EGR cooler orifice temperature, $COT_M$, to the expected EGR cooler orifice temperature, $COT_E$. If $COT_M$ is greater than or equal to $COT_E$, such that $COT_M$ lies between $COT_E$ and the sum of $COT_E$ and the temperature constant, K, algorithm execution advances to step 340 where control computer 50 is operable to set the EGR cooler diagnostic status flag to ABORT, and thereafter to step 342 where algorithm execution is returned to its calling routine. If, on the other hand, control computer 50 determines at step 338 that $COT_M$ is less than $COT_E$, algorithm execution advances to step 344 where control computer 50 increments the pass counter. Thereafter at step 346, control computer 50 compares the count value of the pass counter to a pass count value, PC, and if the count value of the pass counter is less than PC algorithm execution loops back to step 316 (FIG. 6A). If, on the other hand, control computer 50 determines at step 346 that the count value of the pass counter is equal to the pass count value, PC, algorithm execution advances to step 348 where control computer 50 is operable to set the EGR cooler diagnostic status flag to PASS, and thereafter to step 350 where algorithm execution is returned to its calling routine.

Figure 7:
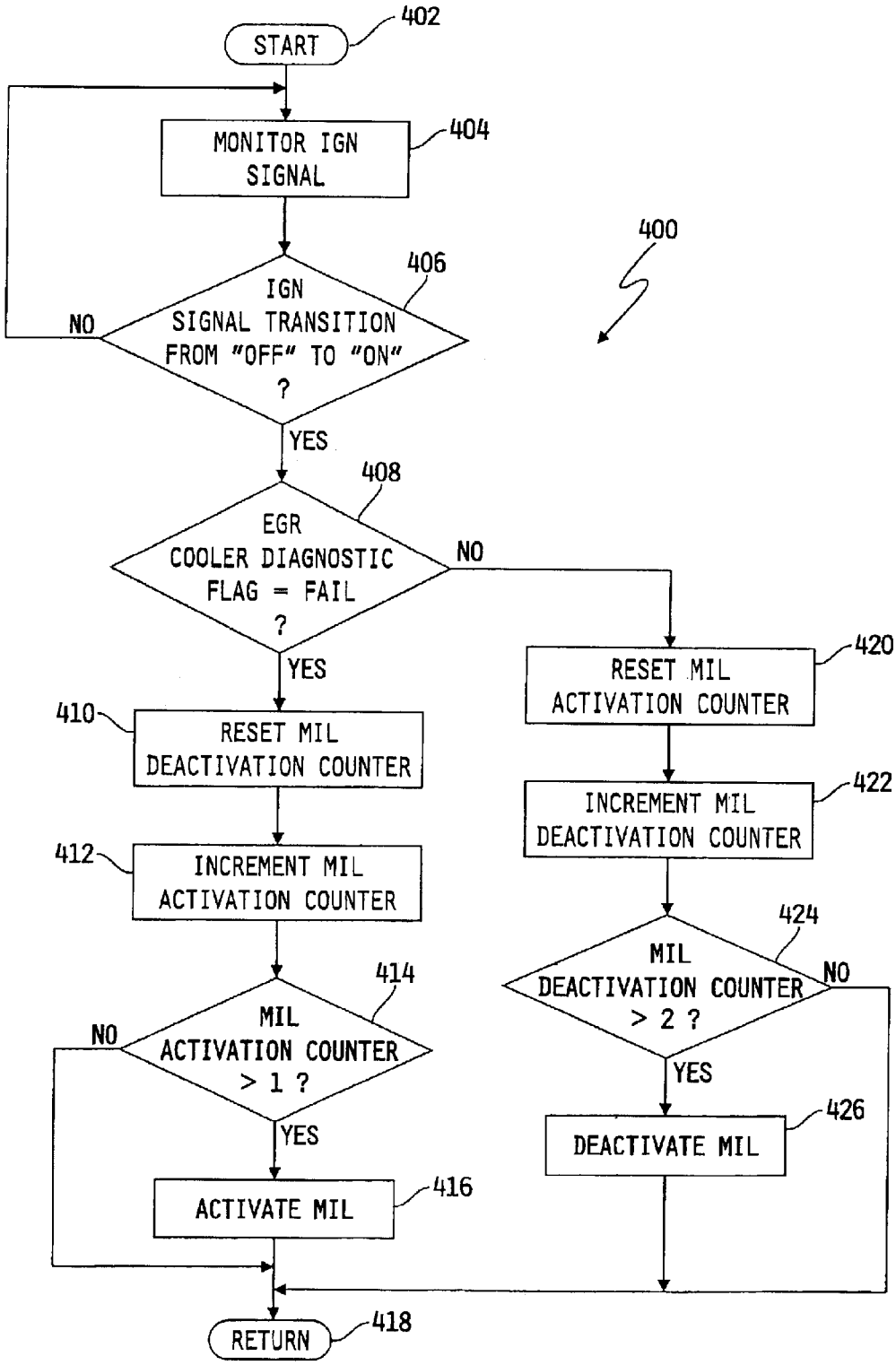
FIG. 7 is a flowchart illustrating one illustrative embodiment of a software algorithm for controlling the operation of a malfunction indicator lamp based on EGR cooler diagnostic status.

Referring now to FIG. 7, a flowchart of one illustrative embodiment of a software algorithm 400 for controlling the operation of a malfunction indicator lamp based on EGR cooler diagnostic status is shown. In one embodiment, algorithm 400 is stored in the EGR cooler fouling diagnostic block 170, and is in any case continually executed by control computer 50 to monitor the status of the EGR cooler diagnostic flag and control operation of the malfunction indicator lamp, 108, based on the status of this flag.

Execution of algorithm 400 begins at step 402, and at step 404 control computer 50 is operable to monitor the ignition signal, IGN, produced by the key switch 84. Thereafter at step 406, control computer 50 is operable to determine whether the ignition signal, IGN, produced by the key switch 84 has switched from the "off" position to the "on" position. If not, algorithm execution loops back to step 404. If, on the other hand, control computer 50 determines at step 406 that the ignition signal, IGN, produced by the key switch 84 has transitioned from the "off" position to the "on" position, algorithm execution advances to step 408 where control computer is operable to determine the status of the EGR cooler diagnostic flag.

If, at step 408, control computer 50 determines that the status of the EGR cooler diagnostic status flag is "FAIL", algorithm execution advances to step 410 where control computer 50 is operable to reset a malfunction indicator lamp (MIL) deactivation counter, and thereafter at step 412 to increment an MIL activation counter. Algorithm execution advances from step 412 to step 414 where control computer 50 is operable to determine whether the count value of the MIL activation counter has exceeded 1, and if so control computer 50 is thereafter operable at step 416 to activate the malfunction indicator lamp 108 via driver circuit 104, as described hereinabove, and is thereafter operable at step 418 to return algorithm execution to its calling routine. If, on the other hand, control computer 50 determines at step 414 that the count value of the MIL activation counter is less than or equal to 1, algorithm execution proceeds directly to step 418 where algorithm execution is returned to its calling routine. Thus, if the EGR cooler diagnostics flag is "FAIL" for two consecutive engine operating cycles, wherein an engine operating cycle is defined for purposes of this document as completion of either of algorithms 200 or 300 following a transition of the ignition signal, IGN, produced by the key switch 84 from its "off" position to its "on" position, control computer 50 is operable to activate the malfunction indicator lamp 108.

If, at step 408, control computer 50 determines that the status of the EGR cooler diagnostic flag is not "FAIL", algorithm execution advances to step 420 where control computer 50 is operable to reset the MIL activation counter, and thereafter at step 422 to increment the MIL deactivation counter. It should be pointed out that prior to the first execution of algorithm 400, both of the MIL activation and deactivation counters are reset. In any case, algorithm execution advances from step 422 to step 424 where control computer 50 is operable to determine whether the count value of the MIL deactivation counter has exceeded 2, and if so control computer 50 is thereafter operable at step 426 to deactivate the malfunction indicator lamp 108 via driver circuit 104, as described hereinabove, and is thereafter operable at step 418 to return algorithm execution to its calling routine. If, on the other hand, control computer 50 determines at step 424 that the count value of the MIL activation counter is less than or equal to 2, algorithm execution proceeds directly to step 418 where algorithm execution is returned to its calling routine. Thus, if the EGR cooler diagnostics flag is not "FAIL" for three consecutive engine operating cycles following a "FAIL" condition, control computer 50 is operable to deactivate the malfunction indicator lamp 108.

While the invention has been illustrated and described in detail in the foregoing drawings and description, the same is to be considered as illustrative and not restrictive in character, it being understood that only preferred embodiments thereof have been shown and described and that all changes and modifications that come within the spirit of the invention are desired to be protected. For example, while various counters have been described hereinabove with respect to algorithms 300 and 400 as being incremented, those skilled in the art will recognize that such counters may alternatively be decremented, and any modifications to either of algorithms 300 or 400 to effectuate the alternative counter configurations would be a mechanical step to a skilled artisan.

What is claimed is:

1. System for diagnosing operation of an exhaust gas recirculation (EGR) cooler, comprising:

an engine having an intake manifold, an exhaust manifold and an EGR conduit fluidly coupled between said intake and exhaust manifolds, said engine including a cooling system having a coolant fluid circulating therethrough to cool said engine;

an EGR cooler disposed in-line with said EGR conduit such that exhaust gas flowing through said EGR conduit also flows through said EGR cooler, said EGR cooler coupled to said cooling system such that said coolant fluid circulates through said EGR cooler to cool exhaust gas flowing therethrough:

means for determining a temperature of exhaust gas produced by said engine;

means for determining a temperature of exhaust gas exiting an exhaust gas outlet of said EGR cooler;

means for determining a temperature of said coolant fluid circulating through said engine cooling system and said EGR cooler;

means for determining a flow rate of exhaust gas through said EGR conduit; and means for diagnosing operation said EGR cooler as a function of said temperature of exhaust gas produced by said engine, said temperature of exhaust gas exiting said EGR cooler, said temperature of said coolant fluid and said flow rate of exhaust gas through said EGR conduit.

2. The system of claim 1 wherein said means for diagnosing operation of said EGR cooler includes means for computing an EGR cooler effectiveness ratio as a function of said temperature of exhaust gas produced by said engine, said temperature of exhaust gas exiting said EGR cooler and said temperature of said coolant fluid.

3. The system of claim 2 wherein said means for computing an EGR cooler effectiveness ratio includes:

means for determining a first temperature difference between said temperature of exhaust gas produced by said engine and said temperature of exhaust gas exiting said EGR cooler;

means for determining a second temperature difference between said temperature of exhaust gas produced by said engine and said temperature of said coolant fluid; and means for determining said EGR cooler effectiveness ratio as a ratio of said first and second temperature differences.

4. The system of claim 2 wherein said means for diagnosing operation of said EGR cooler includes means for determining a first EGR cooler effectiveness ratio threshold as a function of said flow rate of exhaust gas through said EGR conduit.

5. The system of claim 4 wherein said means for diagnosing operation of said EGR cooler includes means for comparing said EGR cooler effectiveness ratio with said first EGR cooler effectiveness ratio threshold and diagnosing said EGR cooler as a fouled EGR cooler if said EGR cooler effectiveness ratio is less than said first EGR cooler effectiveness ratio threshold.

6. The system of claim 5 wherein said means for diagnosing operation of said EGR cooler includes a fail counter having a count value;

and wherein said means for comparing said EGR cooler effectiveness ratio with said first EGR cooler effectiveness ratio threshold is operable to diagnose said EGR cooler as a fouled EGR cooler if said EGR cooler effectiveness ratio is less than said first EGR cooler effectiveness ratio threshold and if said count value of said fail counter has reached a fail count.

7. The system of claim 6 wherein said means for computing an EGR cooler effectiveness ratio is operable to repeatedly compute said EGR cooler effectiveness ratio and said means for determining a first EGR cooler effectiveness ratio threshold is operable to repeatedly determine said first EGR cooler effectiveness ratio;

and wherein said means for comparing said EGR cooler effectiveness ratio with said first EGR cooler effectiveness ratio threshold is operable to repeatedly compare current values of said EGR cooler effectiveness ratio and said first EGR cooler effectiveness ratio threshold and to change said count value of said fail counter for each comparison that said EGR cooler effectiveness ratio is less than said first EGR cooler effectiveness ratio threshold.

8. The system of claim 5 wherein said means for diagnosing operation of said EGR cooler includes means for determining a second EGR cooler effectiveness ratio threshold as a function of said flow rate of exhaust gas through said EGR conduit, said second EGR cooler effectiveness ratio greater than said first EGR cooler effectiveness ratio.

9. The system of claim 8 wherein said means for diagnosing operation of is said EGR cooler includes means for comparing said EGR cooler effectiveness ratio with said second EGR cooler effectiveness ratio threshold and diagnosing said EGR cooler as operating normally if said EGR cooler effectiveness ratio is greater than said second EGR cooler effectiveness ratio threshold.

10. The system of claim 9 wherein said means for diagnosing operation of said EGR cooler includes a pass counter having a count value;

and wherein said means for comparing said EGR cooler effectiveness ratio with said second EGR cooler effectiveness ratio threshold is operable to diagnose said EGR cooler as operating normally if said EGR cooler effectiveness ratio is greater than said second EGR cooler effectiveness ratio threshold and if said count value of said pass counter has reached a pass count.

11. The system of claim 10 wherein said means for computing an EGR cooler effectiveness ratio is operable to repeatedly compute said EGR cooler effectiveness ratio and said means for determining a second EGR cooler effectiveness ratio threshold is operable to repeatedly determine said second EGR cooler effectiveness ratio;

and wherein said means for comparing said EGR cooler effectiveness ratio with said second EGR cooler effectiveness ratio threshold is operable to repeatedly compare current values of said EGR cooler effectiveness ratio and said second EGR cooler effectiveness ratio threshold and to change said count value of said pass counter for each comparison that said EGR cooler effectiveness ratio is greater than said second EGR cooler effectiveness ratio threshold.

12. The system of claim 9 wherein said means for diagnosing operation of said EGR cooler includes means for aborting diagnostic operation of said EGR cooler if said EGR cooler effectiveness ratio is greater than or equal to said first EGR cooler effectiveness ratio threshold and less than or equal to said second EGR cooler effectiveness ratio threshold.

13. The system of claim 12 further including:

means for determining an operating cycle of said engine; and a malfunction indicator lamp;

wherein said means for diagnosing operation of said EGR cooler includes means for activating said malfunction indicator lamp if said EGR cooler is diagnosed as a fouled EGR cooler for at least a first number of consecutive engine operating cycles, and for deactivating said malfunction indicator lamp if said EGR cooler is not diagnosed as a fouled EGR cooler for at least a second number of consecutive engine operating cycles.

14. The system of claim 1 wherein said means for diagnosing operation of said EGR cooler includes means for computing an EGR cooler effectiveness ratio as a function of said flow rate of exhaust gas through said EGR conduit.

15. The system of claim 14 wherein said means for diagnosing operation of said EGR cooler includes means for computing an expected temperature of exhaust gas exiting said EGR cooler as a function of said EGR cooler effectiveness ratio, said temperature of exhaust gas produced by said engine, and said temperature of said coolant fluid.

16. The system of claim 15 wherein said means for computing an expected temperature of exhaust gas exiting said EGR cooler includes:

means for determining a temperature difference between said temperature of exhaust gas produced by said engine and said temperature of said coolant fluid;

means for determining a product of said EGR cooler effectiveness ratio and said temperature difference; and means for computing said expected temperature of exhaust gas exiting said EGR cooler as a difference between said temperature of exhaust gas produced by said engine and said product of said EGR cooler effectiveness ratio and said temperature difference.

17. The system of claim 15 wherein said means for diagnosing operation of said EGR cooler includes means for and diagnosing said EGR cooler as a fouled EGR cooler if said temperature of exhaust gas exiting said EGR cooler is greater than a sum of said expected temperature of exhaust gas exiting said EGR cooler and a temperature constant.

18. The system of claim 17 wherein said means for diagnosing operation of said EGR cooler includes a fail counter having a count value;

and wherein said means for comparing said temperature of exhaust gas exiting said EGR cooler with said expected temperature of exhaust gas exiting said EGR cooler is operable to diagnose said EGR cooler as a fouled EGR cooler if said temperature of exhaust gas exiting said EGR cooler is greater than said sum of said expected temperature of exhaust gas exiting said EGR cooler and said temperature constant and if said count value of said fail counter has reached a fail count.

19. The system of claim 18 wherein said means for computing an EGR cooler effectiveness ratio is operable to repeatedly compute said EGR cooler effectiveness ratio and said means for determining an expected temperature of exhaust gas exiting said EGR cooler is operable to repeatedly determine said expected temperature of exhaust gas exiting said EGR cooler;

and wherein said means for comparing said temperature of exhaust gas exiting said EGR cooler with said expected temperature of exhaust gas exiting said EGR cooler is operable repeatedly compare current values of said temperature of exhaust gas exiting said EGR cooler with said expected temperature of exhaust gas exiting said EGR cooler and to change said count value of said fail counter for each comparison that said temperature of exhaust gas exiting said EGR cooler is greater than said sum of said expected temperature of exhaust gas exiting said EGR cooler and said temperature constant.

20. The system of claim 17 wherein said means for comparing said temperature of exhaust gas exiting said EGR cooler with said expected temperature of exhaust gas exiting said EGR cooler is operable to diagnose said EGR cooler as operating normally if said temperature of exhaust gas exiting said EGR cooler is less than said expected temperature of exhaust gas exiting said EGR cooler.

21. The system of claim 20 wherein said means for diagnosing operation of said EGR cooler includes a pass counter having a count value;

and wherein said means for comparing said EGR cooler with said expected temperature of exhaust gas exiting said EGR cooler is operable to diagnose said EGR cooler as operating normally if said temperature of exhaust gas exiting said EGR cooler is less than said expected temperature of exhaust gas exiting said EGR cooler and if said count value of said pass counter has reached a pass count.

22. The system of claim 21 wherein said means for computing an EGR cooler effectiveness ratio is operable to repeatedly compute said EGR cooler effectiveness ratio and said means for computing an expected temperature of exhaust gas exiting said EGR cooler is operable to repeatedly compute said expected temperature of exhaust gas exiting said EGR cooler;

and wherein said means for comparing said temperature of exhaust gas exiting said EGR cooler with said expected temperature of exhaust gas exiting said EGR cooler is operable to repeatedly compare current values of said temperature of exhaust gas exiting said EGR cooler and said expected temperature of exhaust gas exiting said EGR cooler and to change said count value of said pass counter for each comparison that said temperature of exhaust gas exiting said EGR cooler is less than said expected temperature of exhaust gas exiting said EGR cooler.

23. The system of claim 20 wherein said means for diagnosing operation of said EGR cooler includes means for aborting diagnostic operation of said EGR cooler if said temperature of exhaust gas exiting said EGR cooler is greater than or equal to said expected temperature of exhaust gas exiting said EGR cooler and is less than or equal to said sum of said expected temperature of exhaust gas exiting said EGR cooler and a temperature constant.

24. The system of claim 23 further including:

means for determining an operating cycle of said engine; and a malfunction indicator lamp;

wherein said means for diagnosing operation of said EGR cooler includes means for activating said malfunction indicator lamp if said EGR cooler is diagnosed as a fouled EGR cooler for at least a first number of consecutive engine operating cycles, and for deactivating said malfunction indicator lamp if said EGR cooler is not diagnosed as a fouled EGR cooler for at least a second number of consecutive engine operating cycles.

25. System for diagnosing operation of an exhaust gas recirculation (EGR) cooler, comprising:

an engine having an intake manifold, an exhaust manifold and an EGR conduit fluidly coupled between said intake and exhaust manifolds, said engine including a cooling system having a coolant fluid circulating therethrough to cool said engine;

an EGR cooler disposed in-line with said EGR conduit such that exhaust gas flowing through said EGR conduit also flows through said EGR cooler, said EGR cooler coupled to said cooling system such that said coolant fluid circulates through said EGR cooler to cool exhaust gas flowing therethrough;

means for determining a temperature of exhaust gas produced by said engine;

a first temperature sensor producing an EGR cooler outlet temperature signal indicative of exhaust gas temperature exiting an exhaust gas outlet of said EGR cooler;

a second temperature sensor producing an engine coolant temperature signal indicative of temperature of said coolant fluid;

means for determining a flow rate of exhaust gas through said EGR conduit; and a control computer configured to diagnose operation said EGR cooler as a function of said temperature of exhaust gas produced by said engine, said EGR cooler outlet temperature signal, said engine coolant temperature signal and said flow rate of exhaust gas through said EGR conduit.

26. The system of claim 25 wherein said control computer is configured to compute an EGR cooler effectiveness ratio as a function of said temperature of exhaust gas produced by said engine, said EGR cooler outlet temperature signal and said engine coolant temperature signal.

27. The system of claim 26 wherein said control computer is configured to compute a first temperature difference between said temperature of exhaust gas produced by said engine and said EGR cooler outlet temperature signal, to compute a second temperature difference between said temperature of exhaust gas produced by said engine and said engine coolant temperature signal, and to compute said EGR cooler effectiveness ratio as a ratio of said first and second temperature differences.

28. The system of claim 26 wherein said control computer is configured to compute a first EGR cooler effectiveness ratio threshold as a function of said flow rate of exhaust gas through said EGR conduit.

29. The system of claim 28 wherein said control computer is configured to compare said EGR cooler effectiveness ratio with said first EGR cooler effectiveness ratio threshold and diagnose said EGR cooler as a fouled EGR cooler if said EGR cooler effectiveness ratio is less than said first EGR cooler effectiveness ratio threshold.

30. The system of claim 29 wherein said control computer includes a fail counter having a count value;

and wherein said control computer is configured to diagnose said EGR cooler as a fouled EGR cooler if said EGR cooler effectiveness ratio is less than said first EGR cooler effectiveness ratio threshold and if said count value of said fail counter has reached a fail count.

31. The system of claim 30 wherein said control computer is configured to repeatedly compute and compare said EGR cooler effectiveness ratio and said first EGR cooler effectiveness ratio threshold, said control computer changing said count value of said fail counter for each comparison that said EGR cooler effectiveness ratio is less than said first EGR cooler effectiveness ratio threshold.

32. The system of claim 29 wherein said control computer is configured to compute a second EGR cooler effectiveness ratio threshold as a function of said flow rate of exhaust gas through said EGR conduit, said second EGR cooler effectiveness ratio greater than said first EGR cooler effectiveness ratio.

33. The system of claim 32 wherein said control computer is configured to compare said EGR cooler effectiveness ratio with said second EGR cooler effectiveness ratio threshold and diagnose said EGR cooler as operating normally if said EGR cooler effectiveness ratio is greater than said second EGR cooler effectiveness ratio threshold.

34. The system of claim 33 wherein said control computer includes a pass counter having a count value;

and wherein said control computer is configured to diagnose said EGR cooler as operating normally if said EGR cooler effectiveness ratio is greater than said second EGR cooler effectiveness ratio threshold and if said count value of said pass counter has reached a pass count.

35. The system of claim 34 wherein said control computer is configured to repeatedly compute and compare said EGR cooler effectiveness ratio and said second EGR cooler effectiveness ratio threshold, said control computer changing said count value of said pass counter for each comparison that said EGR cooler effectiveness ratio is greater than said first EGR cooler effectiveness ratio threshold.

36. The system of claim 33 wherein said control computer is configured to abort diagnostic operation of said EGR cooler if said EGR cooler effectiveness ratio is greater than or equal to said first EGR cooler effectiveness ratio threshold and less than or equal to said second EGR cooler effectiveness ratio threshold.

37. The system of claim 36 further including:

means for determining an operating cycle of said engine; and a malfunction indicator lamp;

wherein said control computer is configured to activate said malfunction indicator lamp if said EGR cooler is diagnosed as a fouled EGR cooler for at least a first number of consecutive engine operating cycles, and to deactivate said malfunction indicator lamp if said EGR cooler is not diagnosed as a fouled EGR cooler for at least a second number of consecutive engine operating cycles.

38. The system of claim 25 wherein said control computer is configured to compute an EGR cooler effectiveness ratio as a function of said flow rate of exhaust gas through said EGR conduit.

39. The system of claim 38 wherein said control computer is configured to compute an expected temperature of exhaust gas exiting said EGR cooler as a function of said EGR cooler effectiveness ratio, said temperature of exhaust gas produced by said engine, and said engine coolant temperature signal.

40. The system of claim 39 wherein said control computer is configured to compute a temperature difference between said temperature of exhaust gas produced by said engine and said engine coolant temperature signal, to compute a product of said EGR cooler effectiveness ratio and said temperature difference, and to compute said expected temperature of exhaust gas exiting said EGR cooler as a difference between said temperature of exhaust gas produced by said engine and said product of said EGR cooler effectiveness ratio and said temperature difference.

41. The system of claim 39 wherein said control computer is configured to diagnose said EGR cooler as a fouled EGR cooler if said EGR cooler outlet temperature signal is greater than a sum of said expected temperature of exhaust gas exiting said EGR cooler and a temperature constant.

42. The system of claim 41 wherein said control computer includes a fail counter having a count value;

and wherein said control computer is configured to diagnose said EGR cooler as a fouled EGR cooler if said EGR cooler outlet temperature signal is greater than said sum of said expected temperature of exhaust gas exiting said EGR cooler and said temperature constant and if said count value of said fail counter has reached a fail count.

43. The system of claim 42 wherein said control computer is configured to repeatedly compute said EGR cooler effectiveness ratio and said expected temperature of exhaust gas exiting said EGR cooler, and to compare current values of said EGR cooler outlet temperature signal with said expected temperature of exhaust gas exiting said EGR cooler, said control computer changing said count value of said fail counter for each comparison that said EGR cooler outlet temperature signal is greater than said sum of said expected temperature of exhaust gas exiting said EGR cooler and said temperature constant.

44. The system of claim 41 wherein said control computer is configured diagnose said EGR cooler as operating normally if said EGR cooler outlet temperature signal is less than said expected temperature of exhaust gas exiting said EGR cooler.

45. The system of claim 44 wherein said control computer includes a pass counter having a count value;

and wherein said control computer is configured to diagnose said EGR cooler as operating normally if said EGR cooler outlet temperature is less than said expected temperature of exhaust gas exiting said EGR cooler and if said count value of said pass counter has reached a pass count.

46. The system of claim 45 wherein said control computer is configured to repeatedly compute said EGR cooler effectiveness ratio and said expected temperature of exhaust gas exiting said EGR cooler, and to compare current values of said EGR cooler outlet temperature signal with said expected temperature of exhaust gas exiting said EGR cooler, said control computer changing said count value of said pass counter for each comparison that said EGR cooler outlet temperature signal is less than said expected temperature of exhaust gas exiting said EGR cooler.

47. The system of claim 44 wherein said control computer is configured to abort diagnostic operation of said EGR cooler if said EGR cooler outlet temperature signal is greater than or equal to said expected temperature of exhaust gas exiting said EGR cooler and is less than or equal to said sum of said expected temperature of exhaust gas exiting said EGR cooler and a temperature constant.

48. The system of claim 47 further including:

means for determining an operating cycle of said engine; and a malfunction indicator lamp;

wherein said control computer is configured to activate said malfunction indicator lamp if said EGR cooler is diagnosed as a fouled EGR cooler for at least a first number of consecutive engine operating cycles, and to deactivate said malfunction indicator lamp if said EGR cooler is not diagnosed as a fouled EGR cooler for at least a second number of consecutive engine operating cycles.

* * * * *